US012416430B2

(12) United States Patent
Miyawaki et al.

(10) Patent No.: US 12,416,430 B2
(45) Date of Patent: Sep. 16, 2025

(54) REFRIGERATION CYCLE APPARATUS

(71) Applicant: Mitsubishi Electric Corporation, Tokyo (JP)

(72) Inventors: Kosuke Miyawaki, Tokyo (JP); Yuki Mizuno, Tokyo (JP); Soshi Ikeda, Tokyo (JP); Jun Nishio, Tokyo (JP); Yuji Motomura, Tokyo (JP); Koji Furuya, Tokyo (JP); Hiroki Washiyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 129 days.

(21) Appl. No.: 18/277,585

(22) PCT Filed: Mar. 31, 2021

(86) PCT No.: PCT/JP2021/013849
§ 371 (c)(1),
(2) Date: Aug. 17, 2023

(87) PCT Pub. No.: WO2022/208727
PCT Pub. Date: Oct. 6, 2022

(65) Prior Publication Data

US 2024/0133592 A1 Apr. 25, 2024
US 2024/0230167 A9 Jul. 11, 2024

(51) Int. Cl.
*F25B 1/10* (2006.01)

(52) U.S. Cl.
CPC ..... *F25B 1/10* (2013.01); *F25B 2400/23* (2013.01)

(58) Field of Classification Search
CPC .. F25B 1/10; F25B 41/00; F25B 41/40; F25B 41/42; F25B 2400/23
See application file for complete search history.

(56) References Cited

U.S. PATENT DOCUMENTS 10,508,835 B2 * 12/2019 Ishiyama ..... F25B 39/00
2019/0277550 A1 9/2019 Yokozeki et al.
2022/0057100 A1 2/2022 Ikeda et al.

FOREIGN PATENT DOCUMENTS

EP 3396273 A1 10/2018
EP 3404345 B1 12/2021
(Continued)

OTHER PUBLICATIONS

International Search Report and Written Opinion mailed on May 18, 2021, received for PCT Application PCT/JP2021/013849, filed on Mar. 31, 2021, 9 pages including English Translation.

*Primary Examiner* — Miguel A Diaz
(74) *Attorney, Agent, or Firm* — XSENSUS LLP

(57) ABSTRACT

A refrigeration cycle apparatus includes a main circuit and a bypass circuit. The main circuit includes: a compressor; a first condenser; a first refrigerant-to-refrigerant heat exchanger; a first expansion device; a first branching portion; a first evaporator; a third branching; and a fourth branching portion. The bypass includes: a second expansion device; the first refrigerant-to-refrigerant heat exchanger; and a second branching portion. The second branching portion includes a liquid outflow pipe and a gas outflow pipe. The liquid outflow pipe defines one outlet for the refrigerant and is located below the gas outflow pipe. The gas outflow pipe defines another outlet for the refrigerant and is located above the liquid outflow pipe. The one outlet of the second branching portion communicates with the third branching portion. The other outlet of the second branching portion communicates with the fourth branching portion.

20 Claims, 13 Drawing Sheets

(56) References Cited

FOREIGN PATENT DOCUMENTS

| | | | |
|---|---|---|---|
| GB | 2537766 | A | 10/2016 |
| JP | 2011-257038 | A | 12/2011 |
| JP | 2012-251762 | A | 12/2012 |
| JP | 2014-119220 | A | 6/2014 |
| JP | 2018-185116 | A | 11/2018 |
| JP | 6698951 | B1 | 5/2020 |
| WO | 2015/125252 | A1 | 8/2015 |
| WO | 2015/140887 | A1 | 9/2015 |
| WO | 2017/164333 | A1 | 9/2017 |
| WO | 2019/171600 | A1 | 9/2019 |
| WO | 2020/245982 | A1 | 12/2020 |

* cited by examiner

REFRIGERATION CYCLE APPARATUS

CROSS-REFERENCE TO RELATED APPLICATION

The present application is based on PCT filing PCT/JP2021/013849, filed Mar. 31, 2021, the entire contents of which are incorporated herein by reference.

TECHNICAL FIELD

The present disclosure relates to a refrigeration cycle apparatus.

BACKGROUND ART

In an existing refrigeration cycle apparatus, a heat exchanger is provided to operate, for example, as a condenser mounted in an indoor unit. In the refrigeration cycle apparatus, liquid refrigerant condensed in the heat exchanger is reduced in pressure by an expansion device to change into two-phase gas-liquid refrigerant in which gas refrigerant and liquid refrigerant are mixed together. Then, the two-phase gas-liquid refrigerant flows into a heat exchanger that operates as an evaporator mounted in an outdoor unit, and in this heat exchanger, the liquid refrigerant of the two-phase gas-liquid refrigerant is evaporated to change into low-pressure gas refrigerant. After that, the low-pressure gas refrigerant is sent out from this heat exchanger, flows into a compressor, and is compressed by the compressor to change into high-temperature and high-pressure gas refrigerant. The high-temperature and high-pressure gas refrigerant is then discharged from the compressor. In the refrigeration cycle apparatus, the above cycle is repeated.

Incidentally, it is known as means for such a refrigeration cycle apparatus as described above that refrigerant that flows out of a condenser is caused to flow through a refrigerant flow passage extending from an evaporator to a compressor, as a bypass, in order to reduce a refrigerant pressure loss of a main circuit in which the refrigerant flows, and to improve an energy efficiency (see, for example, Patent Literature 1).

CITATION LIST

Patent Literature

Patent Literature 1: Japanese Unexamined Patent Application Publication No. 2012-251762

SUMMARY OF INVENTION

Technical Problem

In a configuration described in Patent Literature 1, two-phase gas-liquid refrigerant or liquid refrigerant that flows through a bypass circuit joins a main flow that flows through a main circuit. Therefore, in the configuration of Patent Literature 1, when the flow rate of the refrigerant that flows through the bypass circuit is increased in order to reduce the pressure loss of the main circuit, liquid-phase refrigerant is excessively supplied to the compressor to cause a heat loss, and the amount of liquid refrigerant that is supplied to the compressor is increased, thereby degrading the performance of the compressor, and reducing the energy efficiency and energy saving. In order to prevent degradation of the performance of the compressor, it is conceivable that a refrigerant-to-refrigerant heat exchanger or a refrigerant tank of the compressor that is provided in a refrigerant flow passage extending from the evaporator to the compressor is made larger. Alternatively, in order to preventing degradation of the performance of the compressor, it is conceivable that the diameter of a refrigerant pipe that forms the refrigerant flow passage is made larger. However, in order to take such countermeasures as described above, it is necessary to ensure a sufficient installation space for a device or devices and it is therefore hard to ensure both a sufficient high performance of the compressor and a sufficient installation space for the device or devices.

The present disclosure is applied to solve the above problems, and relates to a refrigeration cycle apparatus in which a sufficient high performance of the compressor is ensured and a space required for installation of devices is also ensured.

Solution to Problem

A refrigeration cycle apparatus according to an embodiment of the present disclosure includes: a main circuit in which piping is installed to allow refrigerant to flow in the main circuit: and a bypass circuit in which piping is installed to allow the refrigerant to flow in the bypass circuit, the bypass circuit being provided to branch off from the main circuit and join the main circuit. The main circuit includes: a compressor configured to compress the refrigerant; a first condenser configured to condense the refrigerant: a first refrigerant-to-refrigerant heat exchanger configured to cause heat exchange to be performed between the refrigerant which flows through high-temperature-side flow passages formed in the first refrigerant-to-refrigerant heat exchanger and the refrigerant which flows through low-temperature-side flow passages formed in the first refrigerant-to-refrigerant heat exchanger, the high-temperature-side flow passages forming part of the main circuit; a first expansion device configured to decompress the refrigerant; a first branching portion provided in a refrigerant passage that extends from the first refrigerant-to-refrigerant heat exchanger to the first expansion device, the first branching portion having at least three branches; a first evaporator configured to evaporate the refrigerant; a third branching portion provided in a refrigerant passage that extends from the first evaporator to a suction inlet of the compressor, the third branching portion having at least three branches; and a fourth branching portion provided in a refrigerant passage that extends from the third branching portion to a discharge outlet of the compressor, the fourth branching portion having at least three branches. The bypass circuit forms a refrigerant passage that extends from the first branching portion to the third branching portion and the fourth branching portion, and includes: a second expansion device provided in a refrigerant passage between the first branching portion and the low-temperature-side flow passages of the first refrigerant-to-refrigerant heat exchanger, and configured to decompress the refrigerant: the first refrigerant-to-refrigerant heat exchanger, the low-temperature-side flow passages in the first refrigerant-to-refrigerant heat exchanger forming part of the bypass circuit; and a second branching portion provided in a refrigerant flow passage between the low-temperature-side flow passages and the third branching portion and between the low-temperature-side flow passages and the fourth branching portion, and configured to bifurcate the refrigerant which flows out from the low-temperature-side flow passages of the first refrigerant-to-refrigerant heat exchanger. The second branching portion includes a liquid outflow pipe and a gas outflow pipe. The liquid outflow pipe defines one outlet for the refrigerant and being provided below the gas outflow pipe, and the gas outflow pipe defines another outlet for the refrigerant and being provided above the liquid outflow pipe. The above one outlet of the second branching portion communicating with the third branching portion, and the above other outlet of the second branching portion communicating with the fourth branching portion.

Advantageous Effects of Invention

According to the embodiment of the present disclosure, the refrigeration cycle apparatus includes the second branching portion. The second branching portion includes the liquid outflow pipe, which forms the first outlet for the refrigerant and is located below the gas outflow pipe, and the gas outflow pipe, which forms the second outlet for the refrigerant and is provided above the liquid outflow pipe. The second branching portion bifurcates the refrigerant. Since the second branching portion includes the gas outflow pipe and the liquid outflow pipe, which are provided one above the other in the direction of gravitational force, the second branching portion separates two-phase gas-liquid refrigerant into gas main refrigerant that flows through the gas outflow pipe and liquid main refrigerant that is lower in quality than the gas main refrigerant and that flows through the liquid outflow pipe. In the refrigeration cycle apparatus, by supplying each of these separated refrigerants to part of the main circuit that is located from the evaporator to the discharge outlet of the compressor, it is possible to increase the flow rate of refrigerant in the bypass circuit without excessively supplying liquid refrigerant to the suction inlet of the compressor. Therefore, in the refrigeration cycle apparatus, it is possible to improve the performance of the compressor performance without increasing the size of a device or devices, and thus ensure a sufficient performance of the compressor and a space required for the device or devices,

DESCRIPTION OF EMBODIMENTS

Refrigeration cycle apparatuses according to embodiments of the present disclosure will be described, for example, with reference to the drawings. In each of figures including FIG. 1 which will be referred to below, components that are the same as or equivalent to those in a previous figure or previous figures are denoted by the same reference signs. The same is true of the entire text of the descriptions concerning the embodiments. Furthermore, terms indicating directions (such as "upper", "lower", "right", "left", "front", and "back") are used as appropriate in order that the embodiments be easily understood; and these terms are merely used as a matter of convenience for explanation, and are not intended to limit the location or orientation of each of devices or components. Moreover, the configurations of components referred to in the entire text of the specification are described by way of example; that is, the configurations of the components are not limited to those as descried in the specification.

Embodiment 1

Configuration of Refrigeration Cycle Apparatus 200

Figure 1:
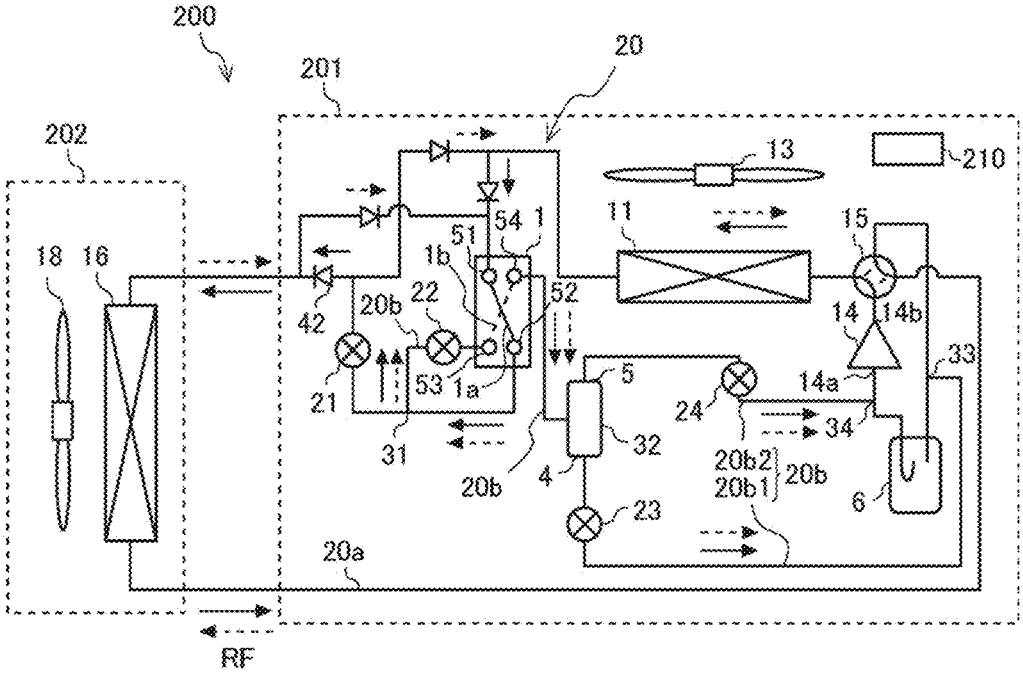
FIG. 1 is a refrigerant circuit diagram illustrating a first example of a refrigeration cycle apparatus according to Embodiment 1.
Figure 2:
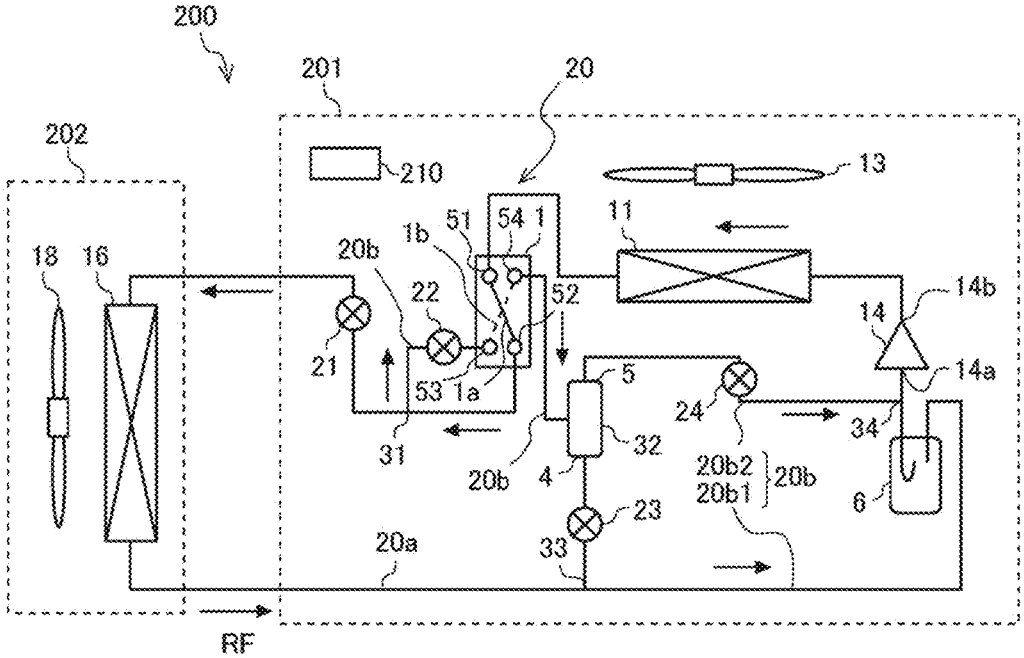
FIG. 2 is a refrigerant circuit diagram in which part of a refrigerant flow passage of the refrigeration cycle apparatus according to Embodiment 1 is omitted.

FIG. 1 is a refrigerant circuit diagram illustrating a first example of a refrigeration cycle apparatus 200 according to Embodiment 1. FIG. 2 is a refrigerant circuit diagram in which part of a refrigerant flow passage 20 in the refrigeration cycle apparatus 200 according to Embodiment 1 is omitted. In FIGS. 1 and 2, solid arrows indicate the flow of refrigerant in a cooling operation, and dashed arrows indicate the flow of the refrigerant in a heating operation. Furthermore, in FIG. 2, for viewability, the refrigerant flow passage 20 in the heating operation as indicated in FIG. 1 is omitted, and the refrigerant flow passage 20 in the cooling operation is extracted from FIG. 1 and is illustrated in FIG. 2.

The refrigeration cycle apparatus 200 is used for refrigeration or air-conditioning, for example, in refrigerators or freezers, self-vending machines, air-conditioning apparatuses, refrigeration apparatuses, and water heaters. As illustrated in FIGS. 1 and 2, the refrigeration cycle apparatus 200 includes an outdoor unit 201 and an indoor unit 202. The outdoor unit 201 includes a compressor 14, a flow switching device 15, an outdoor heat exchanger 11, a first refrigerant-to-refrigerant heat exchanger 1, a first expansion device 21, a second expansion device 22, and an outdoor fan 13. The indoor unit 202 includes an indoor heat exchanger 16 and an indoor fan 18. The refrigeration cycle apparatus 200 may include a controller 210 that controls an operational state, such as cooling operation or heating operation, of the refrigeration cycle apparatus 200.

Furthermore, the refrigeration cycle apparatus 200 includes the refrigerant flow passage 20 which is formed to connect the above components such as the compressor 14. The refrigerant flow passage 20 is made up of refrigerant pipes and forms a flow passage through which refrigerant flows. The refrigerant flow passage 20 is formed such that pipes are provided to connect the outdoor unit 201 and the indoor unit 202, whereby the refrigerant can be moved between the outdoor unit 201 and the indoor unit 202. The refrigerant flow passage 20 includes a main circuit 20*a* in which pipes are sequentially connected to allow the refrigerant to flow, and a bypass circuit 20*b* in which pipes are connected to allow the refrigerant to flow, and the refrigerant flowing through the main circuit 20*a* branches off from the main circuit 20*a*, and then returns to the main circuit 20*a*.

The main circuit 20*a* includes the compressor 14, the outdoor heat exchanger 11, which operates as a first condenser, high-temperature-side flow passages 1*a* of the refrigerant-to-refrigerant heat exchanger 1, the first expansion device 21, and the indoor heat exchanger 16, which operates as a first evaporator In the main circuit 20*a*, the above components are connected by pipes such that the refrigerant flows through the pipes. Furthermore, the main circuit 20*a* includes a first branching portion 31 having at least three branches, a third branching portion 33 having at least three branches, and a fourth branching portion 34 having least three branches. As illustrated in FIG. 1, the main circuit 20*a* may include the flow switching device 15 which is provided between the compressor 14 and the outdoor heat exchanger 11.

The bypass circuit 20*b* branches off at the first branching portion 31 which is located in part of the refrigerant flow passage 20 that is located from the first refrigerant-to-refrigerant heat exchanger 1 of the main circuit 20*a* to the first expansion device 21. The bypass circuit 20*b* forms part of the refrigerant flow passage 20 that is located from the first branching portion 31 to the third branching portion 33 and the fourth branching portion 34. In the bypass circuit 20*b*, piping is installed to cause the refrigerant to flow though the first branching portion 31, the second expansion device 22, low-temperature-side flow passages 1*b* of the first refrigerant-to-refrigerant heat exchanger 1, the second branching portion 32, a third expansion device 23, a fourth expansion device 24, and the third and fourth branching portions 33 and 34, which are connection portions between the bypass circuit 20*b* and the main circuit 20*a*.

The bypass circuit 20*b* includes a first branch passage 20*b*1 and a second branch passage 20*b*2 that branch off at the second branching portion 32. In the refrigeration cycle apparatus 200 according to Embodiment 1, the first branch passage 20*b*1 is a flow passage connecting a liquid outflow pipe 4 of the second branching portion 32 and the third branching portion 33. In the first branch passage 20*b*1, the third expansion device 23 is provided. In the refrigeration cycle apparatus 200 according to Embodiment 1, the second branch passage 20*b*2 is a flow passage connecting a gas outflow pipe 5 of the second branching portion 32 and the fourth branching portion 34. In the second branch passage 20*b*2, the fourth expansion device 24 is provided. In the refrigeration cycle apparatus 200 according to Embodiment 1, the liquid outflow pipe 4 is connected to the third branching portion 33, and the gas outflow pipe 5 is connected to the fourth branching portion 34.

Furthermore, the refrigeration cycle apparatus 200 according to Embodiment 1 includes a check valve 42 and the flow switching device 15 in order to keep the flow direction of the refrigerant in the first refrigerant-to-refrigerant heat exchanger 1 unchanged even when switching between the cooling operation and the heating operation is performed. The check valve 42 is provided in part of the refrigerant flow passage 20 that connects part of the main circuit 20*a* that is located between the first expansion device 21 and the indoor heat exchanger 16 with part of the main circuit 20*a* that is located between the outdoor heat exchanger 11 and the first refrigerant-to-refrigerant heat exchanger 1. The check valve 42 is a device that allows the refrigerant to flow in a single direction. By virtue of the above configuration, in the refrigeration cycle apparatus 200 according to Embodiment 1, the refrigerant which flows through the high-temperature-side flow passages 1*a* in the first refrigerant-to-refrigerant heat exchanger 1 and the refrigerant which flows through the low-temperature-side flow passages 1*b* in the first refrigerant-to-refrigerant heat exchanger 1 flow as countercurrents, and it is therefore possible to cause the above refrigerants to exchange heat with each other without making the first refrigerant-to-refrigerant heat exchanger 1 larger.

The compressor 14 sucks refrigerant, compresses the refrigerant to change it into high-temperature and high-pressure refrigerant, and discharges the high-temperature and high-pressure refrigerant. The refrigerant discharged from the compressor 14 after being compressed is sent out to the flow switching device 15. The compressor 14 is, for example, a rotary compressor, a scroll compressor, a screw compressor, a reciprocating compressor, or other kinds of compressors.

The flow switching device 15 is, for example, a four-way valve and switches the flow direction of the refrigerant in the refrigerant flow passage 20. The flow switching device 15 switches the flow direction of the refrigerant between the flow direction of the refrigerant in the heating operation and that in the cooling operation in the refrigeration cycle apparatus 200. In the heating operation, the flow switching device 15 changes the flow direction of refrigerant by causing a discharge outlet 14*b* of the compressor 14 and the outdoor heat exchanger 11 to be connected with each other and causing a suction inlet 14*a* of the compressor 14 and the indoor heat exchanger 16 to be connected with each other.

In the cooling operation, the flow switching device 15 changes the flow of refrigerant by causing the discharge outlet 14*b* of the compressor 14 and the indoor heat exchanger 16 to be connected with each other and causing the suction inlet 14*a* of the compressor 14 and the outdoor heat exchanger 11 to be connected with each other In the heating operation, the outdoor heat exchanger 11 operates as an evaporator and causes heat exchange to be performed between outdoor air and refrigerant that flows in the outdoor heat exchanger 11, thereby evaporating and gasify the refrigerant. In the cooling operation, the outdoor heat exchanger 11 operates as a condenser and causes heat exchange to be performed between outdoor air and refrigerant that flows in the outdoor heat exchanger 11, thereby condensing and liquefying the refrigerant. In the outdoor heat exchanger 11, in order that heat exchange be performed between the refrigerant and the outdoor air with higher efficiency, the outdoor fan 13 is provided adjacent to the outdoor heat exchanger 11. In the refrigeration cycle apparatus 200 according to Embodiment 1, as illustrated in FIGS. 1 and 2, the outdoor heat exchanger 11 forms a first condenser in the flow direction of the refrigerant in the cooling operation which is indicated by the solid arrows.

In the heating operation, the indoor heat exchanger 16 operates as a condenser and causes heat exchange to be performed between indoor air and refrigerant that flows in the indoor heat exchanger 16, thereby condensing and liquefying the refrigerant. In the cooling operation, the indoor heat exchanger 16 operates as an evaporator and causes heat exchange to be performed between indoor air and refrigerant that flows in the indoor heat exchanger 16, thereby evaporating and gasifying the refrigerant. In the indoor heat exchanger 16, in order that heat exchange be performed between the refrigerant and the indoor air with higher efficiency, the indoor fan 18 is provided adjacent to the indoor heat exchanger 16, It should be noted that in the refrigeration cycle apparatus 200 according to Embodiment 1, as illustrated in FIGS. 1 and 2, the indoor heat exchanger 16 forms a first evaporator in the flow direction of the refrigerant in the cooling operation which is indicated by the solid arrows.

The outdoor heat exchanger 11 and the indoor heat exchanger 16 operate as heat exchangers each of which causes heat exchange to be performed between refrigerant that flows through the refrigerant flow passage 20 and a heat medium such as air that flows outside the pipes. Each of the outdoor heat exchanger 11 and the indoor heat exchanger 16 is, for example, by a fin-and-tube heat exchanger, a micro-channel heat exchanger, a shell-and-tube heat exchanger, a heat-pipe heat exchanger, a double-pipe heat exchanger, or a plate heat exchanger.

The outdoor fan 13 supplies a heat exchange fluid, such as air, to the outdoor heat exchanger 11, and the indoor fan 18 supplies a heat exchange fluid, such as air, to the indoor heat exchanger 16. Each of the outdoor fan 13 and the indoor fan 18 is, for example, a propeller fan, a line flow fan (registered trademark), a multiblade centrifugal fan, or a water pump, which is selected based on operating conditions such as a working fluid, a flow rate, and a static pressure.

The first refrigerant-to-refrigerant heat exchanger 1 includes the high-temperature-side flow passages 1*a* through which high-temperature refrigerant flows, and the low-temperature-side flow passages 1*b* through which refrigerant having a lower temperature than the refrigerant flowing through the high-temperature-side flow passages 1*a* flows. The first refrigerant-to-refrigerant heat exchanger 1 causes heat exchange to be performed between the refrigerant which flows through the high-temperature-side flow passages 1*a* and the refrigerant which flows through the low-temperature-side flow passages 1*b*. The high-temperature-side flow passages 1*a* form part of the main circuit 20*a*, and the low-temperature-side flow passages 1*b* form part of the bypass circuit 20*b*. A configuration of the first refrigerant-to-refrigerant heat exchanger 1 will be described in detail later.

The first branching portion 31 is a branch pipe that branches off in at least three directions, and is part of the refrigerant flow passage 20 at which the bypass circuit 20*b* branches off from the main circuit 20*a*. The first branching portion 31 forms part of the main circuit 20*a*, and at the first branching portion 31, the refrigerant flowing through the main circuit 20*a* branches off into the bypass circuit 20*b*. The first branching portion 31 is provided in part of the refrigerant flow passage 20 that is located from the first refrigerant-to-refrigerant heat exchanger 1 to the first expansion device 21 in the main circuit 20*a*.

The second branching portion 32 is provided in part of the refrigerant flow passage 20 that is located between the low-temperature-side flow passages 1*b* and the third and fourth branching portions 33 and 34. The second branching portion 32 bifurcates refrigerant that flows out from the low-temperature-side flow passages 1*b* of the first refrigerant-to-refrigerant heat exchanger 1. The second branching portion 32 is connected to a low-temperature-side flow passage outlet 54 (see FIG. 3) of the first refrigerant-to-refrigerant heat exchanger 1. The second branching portion 32 includes the liquid outflow pipe 4 and the gas outflow pipe 5. The liquid outflow pipe 4 forms an outlet for the refrigerant and is located below the gas outflow pipe 5 in the direction of gravitational force. The gas outflow pipe 5 forms another outlet for the refrigerant and is located above the liquid outflow pipe 4 in the direction of gravitational force. The above former outlet of the second branching portion 32 communicates with the third branching portion 33, and the above latter outlet of the second branching portion 32 communicates with the fourth branching portion 34. A configuration of the second branching portion 32 will be described in detail later.

The third branching portion 33 is a branch pipe that branches off in at least three directions, and is part of the refrigerant flow passage 20 that connects the bypass circuit 20*b* and the main circuit 20*a*, The third branching portion 33 forms part of the main circuit 20*a*, and at the third branching portion 33, refrigerant flowing though the bypass circuit 20*b* flows into the main circuit 20*a*. The third branching portion 33 is provided in part of the main circuit 20*a* that is located from the indoor heat exchanger 16, which operates as the first evaporator, to the suction inlet 14*a* of the compressor 14, and communicates with the former outlet of the second branching portion 32. As illustrated in FIGS. 1 and 2, the third branching portion 33 is provided upstream of the fourth branching portion 34 in a region between the indoor heat exchanger 16 and the compressor 14 in the flow direction of the refrigerant in the cooling operation which is indicated by the solid arrows.

In the refrigeration cycle apparatus 200 of Embodiment 1, the third branching portion 33 connects the first branch passage 20*b*1 of the bypass circuit 20*b* with the main circuit 20*a*, and at the third branching portion 33, refrigerant that flows through the first branch passage 20*b*1 of the bypass circuit 20*b* flows into the main circuit 20*a*. In the refrigeration cycle apparatus 200 of Embodiment 1, the fourth branching portion 34 is located between the third branching portion 33 and the compressor 14. Furthermore, in the refrigeration cycle apparatus 200 of Embodiment 1, as illustrated in FIGS. 1 and 2, the third branching portion 33 is located upstream of a refrigerant tank 6 in the region between the indoor heat exchanger 16 and the compressor 14 in the flow direction of the refrigerant in the cooling operation which is indicated by the solid arrows.

The fourth branching portion 34 is a branch pipe that branches off in at least three directions, and is part of the refrigerant flow passage 20 that connects the bypass circuit 20*b* with the main circuit 20*a*. The fourth branching portion 34 forms part of the main circuit 20*a*, and at the fourth branching portion 34, refrigerant that flows though the bypass circuit 20*b* flows into the main circuit 20*a*. The fourth branching portion 34 is provided in part of the main circuit 20*a* that is located from the third branching portion 33 to the discharge outlet 14*b* of the compressor 14, and communicates with the second outlet of the second branching portion 32. As illustrated in FIGS. 1 and 2, the fourth branching portion 34 is located downstream of the third branching portion 33 in the region between the indoor heat exchanger 16 and the compressor in the flow direction of the refrigerant in the cooling operation which is indicated by the solid arrows.

In the refrigeration cycle apparatus 200 of Embodiment 1, the fourth branching portion 34 connects the second branch passage 20*b*2 of the bypass circuit 20*b* and the main circuit 20*a*, and at the fourth branching portion 34, refrigerant that flows through the second branch passage 20*b*2 of the bypass circuit 20*b* flows into the main circuit 20*a*. In the refrigeration cycle apparatus 200 of Embodiment 1, the fourth branching portion 34 is located between the compressor 14 and the third branching portion 33. Furthermore, in the refrigeration cycle apparatus 200 of Embodiment 1, as illustrated in FIGS. 1 and 2, the fourth branching portion 34 is located downstream of the refrigerant tank 6 in the region between the indoor heat exchanger 16 and the compressor 14 in the flow direction of the refrigerant in the cooling operation which is indicated by the solid arrows.

Each of the first expansion device 21 and the second expansion device 22 operates as a pressure reducing valve or an expansion valve that expands and decompresses the refrigerant. Each of the first expansion device 21 and the second expansion device 22 is, for example, an electric expansion valve that is capable of adjusting the flow rate of the refrigerant. It should be noted that each of the first expansion device 21 and the second expansion device 22 is not limited to the electric expansion valve, but may be, for example, a mechanical expansion valve that employs a diaphragm as a pressure receiving portion, or a capillary tube.

The first expansion device 21 is provided in the main circuit 20*a*, and is located in part of the refrigerant flow passage 20 that is located between the first branching portion 31 and the indoor heat exchanger 16. The second expansion device 22 is provided in the bypass circuit 20*b* and located in part of the refrigerant flow passage 20 that is located between the first branching portion 31 and a low-temperature-side flow passage inlet 53 (see FIG. 3) of the first refrigerant-to-refrigerant heat exchanger 1.

Each of the third expansion device 23 and the fourth expansion device 24 operates as a pressure reducing valve or an expansion valves that expands and decompresses the refrigerant. Each of the third expansion device 23 and the fourth expansion device 24 is, for example, an electric expansion valve that is capable of adjusting the flow rate of the refrigerant. It should be noted that each of the third expansion device 23 and the fourth expansion device 24 is not limited to the electric expansion valves, but may be, for example, a mechanical expansion valve that employs a diaphragm as a pressure receiving portion, or a capillary tube.

In the refrigeration cycle apparatus 200 of Embodiment 1, the third expansion device 23 is provided in the first branch passage 20*b*1 of the bypass circuit 20*b*, and is located in part of the refrigerant flow passage 20 that is located between the liquid outflow pipe 4 of the second branching portion 32 and the third branching portion 33. Furthermore, in the refrigeration cycle apparatus 200 of Embodiment 1, the fourth expansion device 24 is provided in the second branch passage 20*b*2 of the bypass circuit 20*b*, and is located in part of the refrigerant flow passage 20 that is located between the gas outflow pipe 5 of the second branching portion 32 and the fourth branching portion 34.

The refrigerant tank 6 is a positive-displacement tank. The positive-displacement tank is a tank having a larger inside diameter than the refrigerant pipes that form the refrigerant flow passage 20. The refrigerant tank 6 separates two-phase gas-liquid refrigerant that flows into the refrigerant tank 6 from the outside of the refrigerant tank 6, and lets out gas main refrigerant therefrom. The refrigerant tank 6 has a refrigerant storage function of storing excess refrigerant and a gas-liquid separation function that is fulfilled by retaining liquid refrigerant that is temporarily generated when an operational state changes. In the refrigeration cycle apparatus 200, it is possible to prevent liquid refrigerant from being compressed in the compressor 14, with the gas-liquid separation function of the refrigerant tank 6. In the refrigeration cycle apparatus 200 according to Embodiment 1, the refrigerant tank 6 is provided between the third branching portion 33 and the fourth branching portion 34.

The refrigeration cycle apparatus 200 includes the refrigerant tank 6 and can retain liquid refrigerant. To be more specific, in the refrigeration cycle apparatus 200, since the tank has a larger inside diameter than the refrigerant pipes that form the refrigerant flow passage 20, it is possible to retain liquid refrigerant. Therefore, the refrigerant tank 6 enables liquid main refrigerant that flows into the refrigerant tank 6 to be let out as high-quality refrigerant containing a small amount of a liquid-phase component. The refrigeration cycle apparatus 200 includes the refrigerant tank 6, and can thus supply gas main refrigerant to the compressor 14 and prevent liquid refrigerant from being mixed into gas main refrigerant in the compressor 14. Since the refrigerant tank 6 can supply gas main refrigerant to the compressor 14 and prevent liquid refrigerant from being mixed into the gas main refrigerant in the compressor 14, it is possible to ensure that the refrigeration cycle apparatus 200 provides a high performance.

The controller 210 controls the operational state of the entire operation of the refrigeration cycle apparatus 200, such as the cooling operation or the heating operation. The controller 210 may control the flow switching device 15 to cause refrigerant to switch the flow direction of the refrigerant in the refrigerant flow passage 20. The controller 210 may also control the compressor 14, for example, to control the amount of compressed refrigerant that is to be discharged. The controller 210 may also control the rotating speeds of the outdoor fan 13 and the indoor fan 16. The controller 210 may also adjust the opening degrees of the first expansion device 21, the second expansion device 22, the third expansion device 23, and the fourth expansion device 24.

The controller 210 is, for example, a device, such as a computer, which executes control arithmetic processing mainly with a central processing unit (CPU). The controller 210 fulfills the function of each of components, by reading out and executing a program stored in a storage module (not illustrated). This description concerning the controller 210 is not limiting, and the components of the controller 210 may be provided as separate dedicated devices (hardware).

Operation of Refrigeration Cycle Apparatus 200

Next, an operation of the refrigeration cycle apparatus 200 will be described together with the flow of the refrigerant, First of all, the cooling operation by the refrigeration cycle apparatus 200 will be described. It should be noted that the flow of the refrigerant in the cooling operation is indicated by the solid arrows in FIGS. 1 and 2. In the following description concerning the operation of the refrigeration cycle apparatus 200, it is assumed by way of example that the heat exchange fluid is air and a fluid to be subjected to heat exchange is refrigerant.

The refrigeration cycle apparatus 200 drives the compressor 14 to cause high-temperature and high-pressure gas refrigerant to be discharged from the compressor 14. In the refrigeration cycle apparatus 200, refrigerant flows through the refrigerant flow passage 20 in the directions indicated by the solid arrows. The high-temperature and high-pressure gas refrigerant (single phase) discharged from the compressor 14 flows into the outdoor heat exchanger 11, which operates as the first condenser, via the flow switching device 15.

At the outdoor heat exchanger 11, heat exchange is performed between high-temperature and high-pressure gas refrigerant that has flowed into the outdoor heat exchanger 11 and air supplied by the outdoor fan 13. The refrigerant subjected to heat exchange in the outdoor heat exchanger 11 condenses to change into high-pressure liquid refrigerant (single phase) or two-phase gas-liquid refrigerant.

The high-pressure liquid refrigerant sent out from the outdoor heat exchanger 11, which operates as the first condenser, flows into the first refrigerant-to-refrigerant heat exchanger 1 and flows through the high-temperature-side flow passages 1*a* of the first refrigerant-to-refrigerant heat exchanger 1. The refrigerant flowing through the high-temperature-side flow passages 1*a* of the first refrigerant-to-refrigerant heat exchanger 1 is cooled by heat exchange with the refrigerant flowing through the low-temperature-side flow passages 1*b* of the first refrigerant-to-refrigerant heat exchanger 1, thereby changing into high-pressure liquid refrigerant (single phase). The high-pressure liquid refrigerant then flows out from the high-temperature-side flow passages 1*a* of the first refrigerant-to-refrigerant heat exchanger 1.

Part of the refrigerant that has flowed out from the high-temperature-side flow passages 1*a* of the first refrigerant-to-refrigerant heat exchanger 1 flows into the first expansion device 21 via the first branching portion 31 and flows through the main circuit 20*a*, and the remaining part of the refrigerant flows into the second expansion device 22 and flows through the bypass circuit 20*b*.

In the main circuit 20*a*, two-phase refrigerant that is a mixture of low-pressure gas refrigerant and liquid refrigerant decompressed via the first expansion device 21 flows into the indoor heat exchanger 16, which operates as the first evaporator. At the indoor heat exchanger 16, heat exchange is performed between the two-phase refrigerant that has flowed into the indoor heat exchanger 16 and air supplied by the indoor fan 18, and the liquid refrigerant of the two-phase refrigerant evaporates to change into low-pressure gas refrigerant (single phase). As the result of this heat exchange, the air that has exchanged heat with the refrigerant is supplied to an indoor space, and the indoor space is thus cooled.

On the other hand, in the bypass circuit 20*b*, middle-pressure liquid refrigerant (single phase) or liquid main two-phase gas-liquid refrigerant that is decompressed via the second expansion device 22 flows into the low-temperature-side flow passages 1*b* of the first refrigerant-to-refrigerant heat exchanger 1 and flows through the low-temperature-side flow passages 1*b* of the first refrigerant-to-refrigerant heat exchanger 1. The refrigerant flowing through the low-temperature-side flow passages 1*b* of the first refrigerant-to-refrigerant heat exchanger 1 exchanges heat with the refrigerant flowing through the high-temperature-side flow passages 1*a* of the first refrigerant-to-refrigerant heat exchanger 1 to change into middle-pressure two-phase gas-liquid refrigerant. The middle-pressure two-phase gas-liquid refrigerant then flows out from the low-temperature-side flow passages 1*b* of the first refrigerant-to-refrigerant heat exchanger 1.

The middle-pressure two-phase gas-liquid refrigerant that has flowed out from the low-temperature-side flow passages 1*b* of the first refrigerant-to-refrigerant heat exchanger 1 flows into the second branching portion 32. The two-phase gas-liquid refrigerant that has flowed into the second branching portion 32 separates into liquid main refrigerant 61 (see FIG. 6) containing a larger number of liquid components and gas main refrigerant 62 (see FIG. 6) containing a larger number of gas components. The liquid main refrigerant 61 flows through the liquid outflow pipe 4 of the second branching portion 32, and the gas main refrigerant 62 flows through the gas outflow pipe 5 of the second branching portion 32. In the refrigeration cycle apparatus 200 according to Embodiment 1, the liquid main refrigerant 61 flows from the liquid outflow pipe 4 to the third branching portion 33, and the gas main refrigerant 62 flows from the gas outflow pipe 5 to the fourth branching portion 34.

Low-pressure gas refrigerant that has flowed out from the indoor heat exchanger 16 provided in the main circuit 20*a* joins the liquid main refrigerant 61 at the third branching portion 33 before the low-pressure gas refrigerant is compressed by the compressor 14 via the flow switching device 15 to change into high-temperature and high-pressure gas refrigerant. Furthermore, the refrigerant that has joined the liquid main refrigerant 61 at the third branching portion 33 and flows through the main circuit 20*a* then joins the gas main refrigerant 62 at the fourth branching portion 34. The refrigerant that has flowed out from the indoor heat exchanger 16, has joined the liquid main refrigerant 61 at the third branching portion 33, and then has joined the gas main refrigerant 62 at the fourth branching portion 34 flows into the compressor 14, is re-compressed by the compressor 14, and is discharged from the compressor 14. Thereafter, in the refrigeration cycle apparatus 200, the above cycle is repeated.

In general, in the above cooling operation or heating operation, when liquid refrigerant flows into a compressor, liquid compression occurs and causes a failure in the compressor. The controller 210 of the refrigeration cycle apparatus 200 controls the fourth expansion device 24, causes the fourth expansion device 24 to be in a closed state at the time of startup and causes the fourth expansion device 24 to be in an opened state after the elapse of a certain period of time. The fourth expansion device 24 is provided in part of the refrigerant flow passage 20 that is located from the second branching portion 32 to the fourth branching portion 34. The above control by the controller 210 prevents liquid refrigerant which was present in the outdoor heat exchanger 11 and the first refrigerant-to-refrigerant heat exchanger 1 at the time of shutdown from being directly supplied to the compressor 14.

Regarding Second Branching Portion 32

Figure 3:
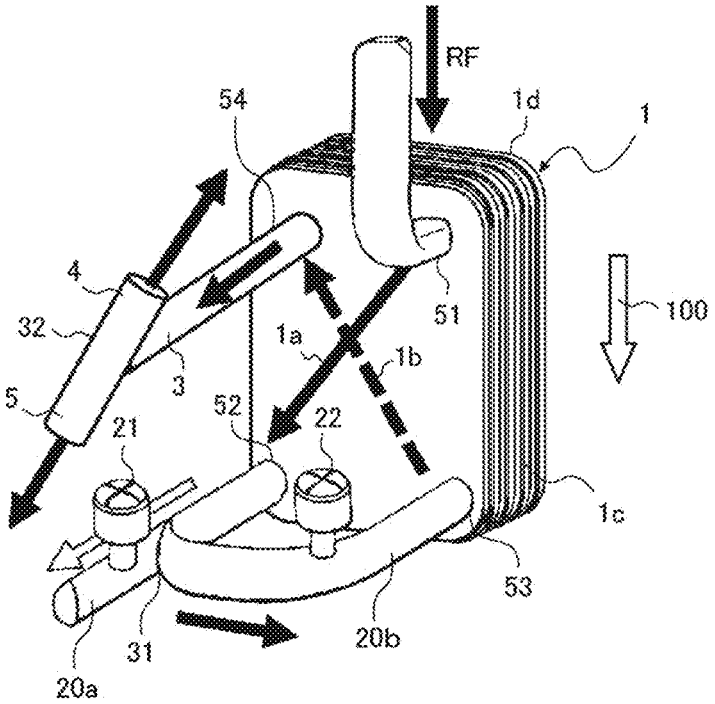
FIG. 3 is a perspective view illustrating an example of a first refrigerant-to-refrigerant heat exchanger that is mounted in the refrigeration cycle apparatus according to Embodiment 1.

FIG. 3 is a perspective view illustrating an example of the first refrigerant-to-refrigerant heat exchanger 1 which is mounted in the refrigeration cycle apparatus 200 according to Embodiment 1. The first refrigerant-to-refrigerant heat exchanger 1 and the second branching portion 32 which are used in the refrigeration cycle apparatus 200 according to Embodiment 1 will be described with reference to FIG. 3. In figures including FIG. 3 which will be referred to below, solid arrows and dashed arrows indicate the flow directions of refrigerant RF, and outlined arrows indicate the direction of gravitational force 100.

As illustrated in FIG. 3, the second branching portion 32 is directly connected to the first refrigerant-to-refrigerant heat exchanger 1 or is connected to the first refrigerant-to-refrigerant heat exchanger 1 by another pipe. First of all, the first refrigerant-to-refrigerant heat exchanger 1, to which the second branching portion 32 is connected, will be described. The first refrigerant-to-refrigerant heat exchanger 1 is, for example, a plate heat exchanger.

The first refrigerant-to-refrigerant heat exchanger 1 includes a main body 1*d* in which a plurality of heat transfer plates 1*c* are stacked together. In the main body 1*d*, the high-temperature-side flow passages 1*a* and the low-temperature-side flow passages 1*b* are formed. In the high-temperature-side flow passages 1*a*, high-temperature refrigerant flows, and in the low-temperature-side flow passages 1*b*, refrigerant having a lower temperature than the refrigerant flowing through the high-temperature-side flow passages 1*a* flows. In the first refrigerant-to-refrigerant heat exchanger 1, the high-temperature-side flow passages 1*a* and the low-temperature-side flow passages 1*b* are formed in the main body 1*d* at least such that the refrigerant flowing through the high-temperature-side flow passages 1*a* and the refrigerant flowing through the low-temperature-side flow passages 1*b* flow separately from each other.

In the main body 1*d*, the high-temperature-side flow passages 1*a* and the low-temperature-side flow passages 1*b* are alternately formed such that with respect to each of the plurality of heat transfer plates 1*c*, an associated one of the high-temperature-side flow passages 1*a* and an associated one the low-temperature-side flow passages 1*b* are located opposite to each other. In the first refrigerant-to-refrigerant heat exchanger 1, heat exchange is performed between the refrigerant flowing through the high-temperature-side flow passages 1*a* and the refrigerant flowing through the low-temperature-side flow passages 1*b*. It should be noted that the first refrigerant-to-refrigerant heat exchanger 1 is not limited to the plate heat exchanger, and may be any type of heat exchanger as long as the heat exchanger causes heat exchange to be performed between the refrigerant flowing through the high-temperature-side flow passages 1*a* and the refrigerant flowing through the low-temperature-side flow passages 1*b*.

In the main body 1*d*, a high-temperature-side flow passage inlet 51 and a low-temperature-side flow passage inlet 53 are formed to allow the refrigerant RF to flow into the main body 1*d* therethrough. Furthermore, in the main body 1*d*, a high-temperature-side flow passage outlet 52 and a low-temperature-side flow passage outlet 54 are formed to allow the refrigerant RF to flow out of the main body 1*d* therethrough. The high-temperature-side flow passage inlet 51 and the high-temperature-side flow passage outlet 52 are an inlet and an outlet of the high-temperature-side flow passages 1*a*, respectively. The low-temperature-side flow passage inlet 53 and the low-temperature-side flow passage outlet 54 are an inlet and an outlet of the low-temperature-side flow passages 1*b*, respectively.

The high-temperature-side flow passage inlet 51 is a refrigerant inlet of the high-temperature-side flow passage 1*a* and also allows the refrigerant to flow into the first refrigerant-to-refrigerant heat exchanger 1. The high-temperature-side flow passage outlet 52 is a refrigerant outlet of the high-temperature-side flow passages 1*a* and also allows the refrigerant to flow out toward the first branching portion 31. The low-temperature-side flow passage inlet 53 is a refrigerant inlet of the low-temperature-side flow passages 1*b* and also allows the refrigerant which has branched off from the first branching portion 31 and passed through the second expansion device 22 to flow into the low-temperature-side flow passage inlet 53. The low-temperature-side flow passage outlet 54 is a refrigerant outlet of the low-temperature-side flow passages 1*b* and also allows refrigerant flowing toward the second branching portion 32 to flow out.

The high-temperature-side flow passage outlet 52 and the low-temperature-side flow passage inlet 53 are formed below the low-temperature-side flow passage outlet 54. That is, part of the refrigerant flow passage 20 that is connected to the first branching portion 31 and located on an outlet side of the first refrigerant-to-refrigerant heat exchanger 1 and part of the refrigerant flow passage 20 that is connected to the second expansion device 22 and located on an inlet side of the first refrigerant-to-refrigerant heat exchanger 1 are both provided below part of the refrigerant flow passage 20 that is connected to the second branching portion 32 and located at an outlet side of the first refrigerant-to-refrigerant heat exchanger 1.

The refrigerant RF is supplied from the outdoor heat exchanger 11, which operates as the first condenser, to the first refrigerant-to-refrigerant heat exchanger 1. The refrigerant RF supplied from the outdoor heat exchanger 11 to the first refrigerant-to-refrigerant heat exchanger 1 flows into the main body 1*d* through the high-temperature-side flow passage inlet 51, passes through the high-temperature-side flow passages 1*a* formed in the main body 1*d*, and flows out of the main body 1*d* through the high-temperature-side flow passage outlet 52.

After that, the refrigerant RF branches off at the first branching portion 31 into refrigerant that flows in the main circuit 20*a* and into the first expansion device 21 and refrigerant that flows in the bypass circuit 20*b* and into the second expansion device 22.

After flowing out of the second expansion device 22, the refrigerant flowing in the bypass circuit 20*b* flows into the main body 1*d* through the low-temperature-side flow passage inlet 53, passes through the low-temperature-side flow passages 1*b* formed in the main body 1*d*, and flows out of the main body 1*d* through the low-temperature-side flow passage outlet 54. In this case, the first refrigerant-to-refrigerant heat exchanger 1 causes heat exchange to be performed between the refrigerant flowing through the low-temperature-side flow passages 1*b* and the refrigerant flowing through high-temperature-side flow passages Ia. Then, after flowing out from low-temperature-side flow passage outlet 54, the refrigerant RF flows into the second branching portion 32.

In the case where, as illustrated in FIG. 3, the first refrigerant-to-refrigerant heat exchanger 1 is a plate heat exchanger in which the high-temperature-side flow passages 1*a* and the low-temperature-side flow passages 1*b* are alternately formed, it is appropriate that the high-temperature-side flow passage outlet 52, the low-temperature-side flow passage inlet 53, and the low-temperature-side flow passage outlet 54 are provided to satisfy the following positional relationship. It is preferable that as mentioned above, the first refrigerant-to-refrigerant heat exchanger 1 be configured such that the high-temperature-side flow passage outlet 52 and the low-temperature-side flow passage inlet 53 are formed below the low-temperature-side flow passage outlet 54 in the direction of gravitational force 100. By virtue of the above configuration, in the first refrigerant-to-refrigerant heat exchanger 1, liquid refrigerant easily fall off by gravity from the low-temperature-side flow passage outlet 54 to the low-temperature-side flow passage inlet 53, the liquid refrigerant can be prevented from flowing into the second branching portion 32, and a gas-liquid separation effect is improved.

Figure 4:
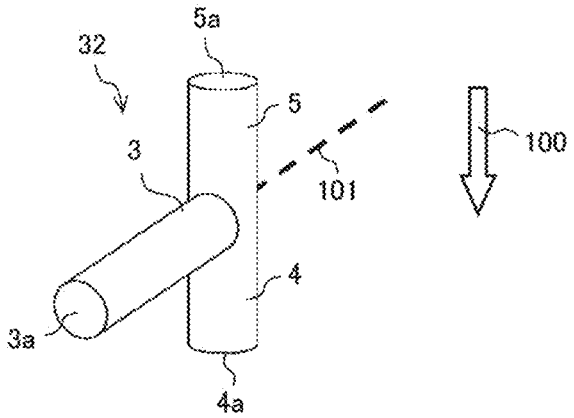
FIG. 4 is a perspective view of a second branching portion that is connected to the first refrigerant-to-refrigerant heat exchanger as illustrated in FIG. 3.
Figure 5:
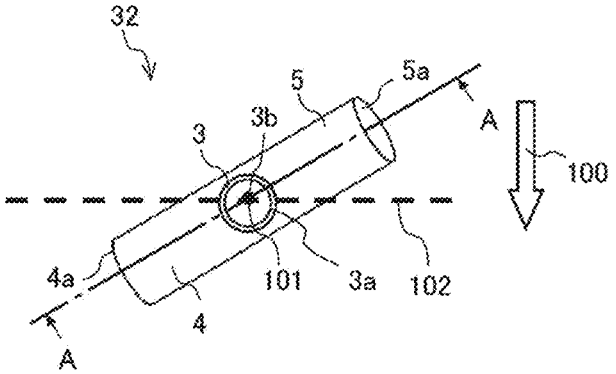
FIG. 5 is a schematic view of an example in which the second branching portion as illustrated in FIG. 4 is seen from a direction perpendicular to a flow passage cross-section of an inflow pipe.

FIG. 4 is a perspective view of the second branching portion 32 which is connected to the first refrigerant-to-refrigerant heat exchanger 1 as illustrated in FIG. 3. FIG. 5 is a schematic view of an example in which the second branching portion 32 as illustrated in FIG. 4 is seen from a direction perpendicular to a flow passage cross-section of the inflow pipe 3. It should be noted that FIG. 5 is a schematic view of the second branching portion 32 as seen in a horizontal direction perpendicular to the direction of gravitational force 100 and in a direction along a normal 101 as illustrated in FIG. 4.

As illustrated in FIGS. 4 and 5, the second branching portion 32 is a branch pipe, and includes the inflow pipe 3, the liquid outflow pipe 4, and the gas outflow pipe 5. The second branching portion 32 is, for example, a two-branch pipe, and is a T-shaped pipe. It should be noted that the second branching portion 32 is not limited to the T-shaped pipe, and as the second branching portion 32, any type of branch pipe may be used as long as it is configured at least to bifurcate the refrigerant RF.

The inflow pipe 3 is a pipe through which the refrigerant RF flows in after passing through the low-temperature-side flow passages 1*b* of the first refrigerant-to-refrigerant heat exchanger 1 and flowing out from the low-temperature-side flow passage outlet 54. The inflow pipe 3 is directly connected to the low-temperature-side flow passage outlet 54 or connected to the low-temperature-side flow passage outlet 54 by another pipe. The liquid outflow pipe 4 and the gas outflow pipe 5 are pipes in which the refrigerant RF branches off and flows after flowing in from the inflow pipe 3. The second branching portion 32 is configured such that an end of the inflow pipe 3 forms an inlet 3*a* for the refrigerant RF, an end of the liquid outflow pipe 4 forms an outlet 4*a* for refrigerant, and an end of the gas outflow pipe 5 forms an outlet 5*a* for refrigerant.

As illustrated in FIG. 4, the liquid outflow pipe 4 is a pipe forming an outlet for the refrigerant and located below the gas outflow pipe 5 in the direction of gravitational force 100, and the gas outflow pipe 5 is a pipe forming an outlet for the refrigerant and located above the liquid outflow pipe 4 in the direction of gravitational force 100. The second branching portion 32 is configured such that in the direction of gravitational force 100, the gas outflow pipe 5 is provided above the liquid outflow pipe 4 and the liquid outflow pipe 4 is provided below the gas outflow pipe 5.

As illustrated in FIG. 5, it is appropriate that the second branching portion 32 includes have at least one outflow pipe provided below or above a horizontal plane 102 that is perpendicular to the direction of gravitational force 100 and that includes a center 3*b* of the flow passage cross-section of the inflow pipe 3. It is appropriate that the second branching portion 32 includes the liquid outflow pipe 4 provided below the horizontal plane 102 and the gas outflow pipe 5 provided above the horizontal plane 102. As illustrated in FIG. 5, a direction along the tube axis of the liquid outflow pipe 4 or a direction along the tube axis of the gas outflow pipe 5 may be inclined with respect to the horizontal plane 102.

Referring to FIG. 3, the inflow pipe 3 of the second branching portion 32 is formed in the shape of a straight pipe and is connected to the low-temperature-side flow passage outlet 54 of the first refrigerant-to-refrigerant heat exchanger 1. However, the configuration of the second branching portion 32 is not limited to such a configuration, and the second branching portion 32 may include a bent pipe or may include another branch flow passage, as long as the liquid outflow pipe 4 is provided below the gas outflow pipe 5.

Figure 6:
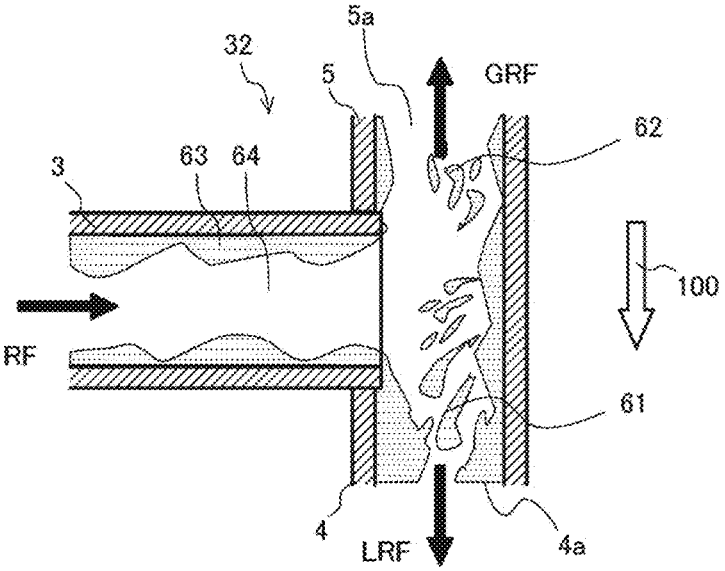
FIG. 6 is a sectional view for explanation of the flow of refrigerant at the second branching portion and schematically illustrating a section of the second branching portion.

FIG. 6 is a sectional view for explanation of the flow of refrigerant at the second branching portion 32 and schematically illustrating a section of the second branching portion 32. FIG. 6 is a vertical sectional view of the second branching portion 32 that is taken along the direction along the tube axis and along line A-A in FIG. 5. A refrigerant flow GRF as illustrated in FIG. 6 is the flow of the gas main refrigerant 62, and a refrigerant flow LRF as illustrated in the figure is the flow of the liquid main refrigerant 61. The flow of the refrigerant RF through the second branching portion 32 will be described with reference to FIG. 6.

After passing through the low-temperature-side flow passages 1*b* of the first refrigerant-to-refrigerant heat exchanger 1 and flowing out from the low-temperature-side flow passage outlet 54, the refrigerant RF flows in through the inlet 3*a* of the inflow pipe 3. After flowing in from the inflow pipe 3, the refrigerant RF branches off to flow into the liquid outflow pipe 4 and the gas outflow pipe 5, and then flows out from the outlet 4*a* of the liquid outflow pipe 4 and the outlet 5*a* of the gas outflow pipe 5.

After flowing in from the inflow pipe 3, the two-phase gas-liquid refrigerant RF branches off at the second branching portion 32 such that liquid main refrigerant 61 is caused by the effect of gravity to flow toward the liquid outflow pipe 4 located below the gas outflow pipe 5. The liquid main refrigerant 61 is refrigerant containing a large amount of liquid refrigerant 63 which is relatively high in density.

Furthermore, after flowing in from the inflow pipe 3, the two-phase gas-liquid refrigerant RF branches off at the second branching portion 32 such that gas main refrigerant 62 is caused by a buoyancy to flow toward the gas outflow pipe 5 located above the liquid outflow pipe 4. The gas main refrigerant 62 is refrigerant containing a larger amount of gas refrigerant 64 than the liquid refrigerant 63. The gas refrigerant 64 is relatively low in density.

Figure 7:
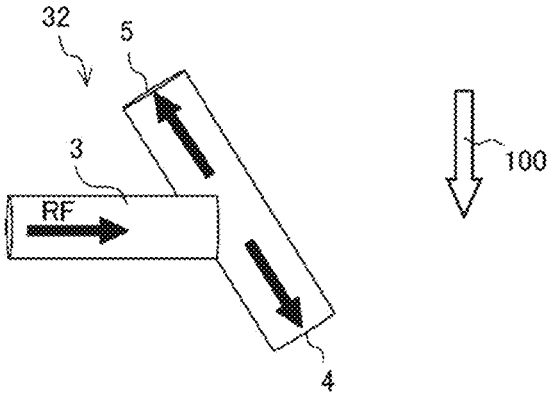
FIG. 7 is a schematic view illustrating a first modification of the second branching portion.
Figure 8:
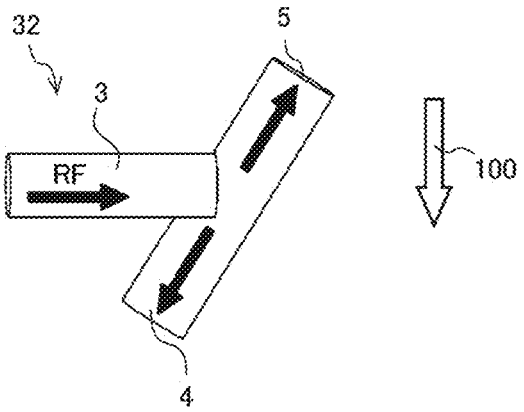
FIG. 8 is a schematic view illustrating a second modification of the second branching portion.

FIG. 7 is a schematic view illustrating a first modification of the second branching portion 32. FIG. 8 is a schematic view illustrating a second modification of the second branching portion 32. The configuration of the second branching portion 32 is not limited to a configuration in which, as illustrated in FIG. 4, the liquid outflow pipe 4 and the gas outflow pipe 5 are integrally formed in the shape of a straight pipe extending in the direction of gravitational force 100. As illustrated in FIGS. 7 and 8, in the second branching portion 32, the liquid outflow pipe 4 and the gas outflow pipe 5 may be formed in the shape of a straight pipe inclined with respect to the direction of gravitational force 100.

As illustrated in FIG. 7, the second branching portion 32 may be formed such that in the flow direction of the refrigerant RF flowing through the inflow pipe 3, the flow direction of refrigerant flowing through the gas outflow pipe 5 has a component directed in the opposite direction to the flow direction of the refrigerant RF flowing through the inflow pipe 3. Furthermore, the second branching portion 32 may be formed such that in the flow direction of the refrigerant RF flowing through the inflow pipe 3, the flow direction of refrigerant flowing through the liquid outflow pipe 4 has a component directed in the same direction as the flow direction of the refrigerant RF flowing through the inflow pipe 3.

As illustrated in FIG. 8, the second branching portion 32 may be formed such that in the flow direction of the refrigerant RF flowing through the inflow pipe 3, the flow direction of refrigerant flowing through the liquid outflow pipe 4 has a component directed in the opposite direction to the flow direction of the refrigerant RF flowing through the inflow pipe 3. Furthermore, the second branching portion 32 may be formed such that in the flow direction of the refrigerant RF flowing through the inflow pipe 3, the flow direction of refrigerant flowing through the gas outflow pipe 5 has a component directed in the same direction as the flow direction of the refrigerant RF flowing through the inflow pipe 3.

Figure 9:
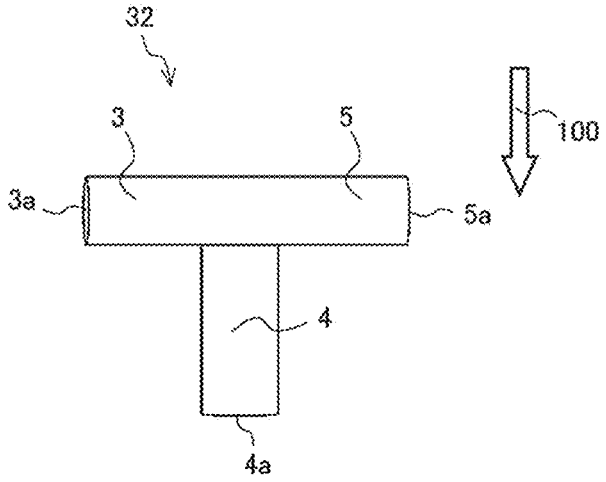
FIG. 9 is a schematic view illustrating a third modification of the second branching portion.

FIG. 9 is a schematic view illustrating a third modification of the second branching portion 32. The configuration of the second branching portion 32 is not limited to a configuration in which, as illustrated in FIG. 4, the liquid outflow pipe 4 and the gas outflow pipe 5 are integrally formed in the shape of a straight pipe extending in the direction of gravitational force 100. As illustrated in FIG. 9, in the second branching portion 32, the inflow pipe 3 and the gas outflow pipe 5 may be integrally formed in the shape of a straight pipe. The liquid outflow pipe 4 is connected to the inflow pipe 3 and the gas outflow pipe 5 which are formed in the shape of a straight pipe, and is formed to extend downward from the inflow pipe 3 and the gas outflow pipe 5 formed in the shape of a straight pipe. The outlet 4*a* of the liquid outflow pipe 4 faces downward.

Figure 10:
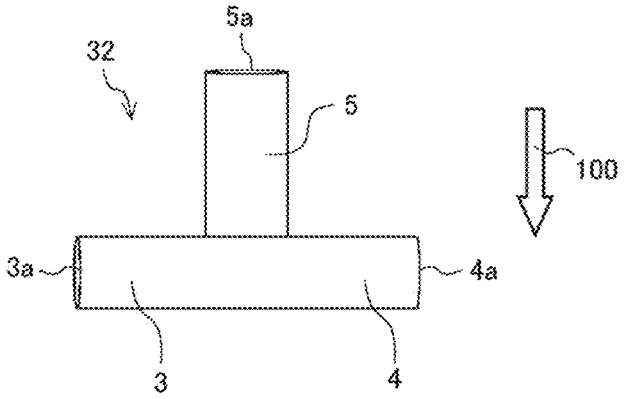
FIG. 10 is a schematic view illustrating a fourth modification of the second branching portion.

FIG. 10 is a schematic view illustrating a fourth modification of the second branching portion 32. The configuration of the second branching portion 32 is not limited to a configuration in which, as illustrated in FIG. 4, the liquid outflow pipe 4 and the gas outflow pipe 5 are integrally formed in the shape of a straight pipe extending in the direction of gravitational force 100. As illustrated in FIG. 10, the second branching portion 32 may be formed such that the inflow pipe 3 and the liquid outflow pipe 4 are integrally formed in the shape of a straight pipe. The gas outflow pipe 5 is connected to the inflow pipe 3 and the liquid outflow pipe 4 which are formed in the shape of a straight pipe, and is formed to extend upward from the inflow pipe 3 and the liquid outflow pipe 4. The outlet 5*a* of the gas outflow 5 faces upward.

Figure 11:
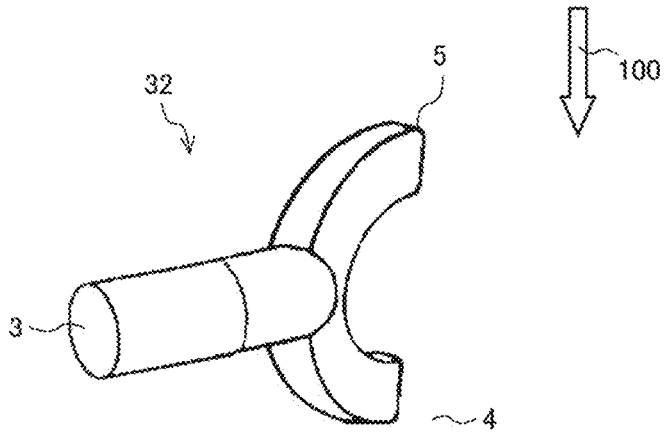
FIG. 11 is a schematic view illustrating a fifth modification of the second branching portion.

FIG. 11 is a schematic view illustrating a fifth modification of the second branching portion 32. The second branching portion 32 is not limited to the above T-shaped pipe, but, as illustrated in FIG. 11, may be Y-shaped. Furthermore, as illustrated in FIG. 11, the second branching portion 32 may be formed such that the liquid outflow pipe 4 and the gas outflow pipe 5 are combined U-shaped.

Figure 12:
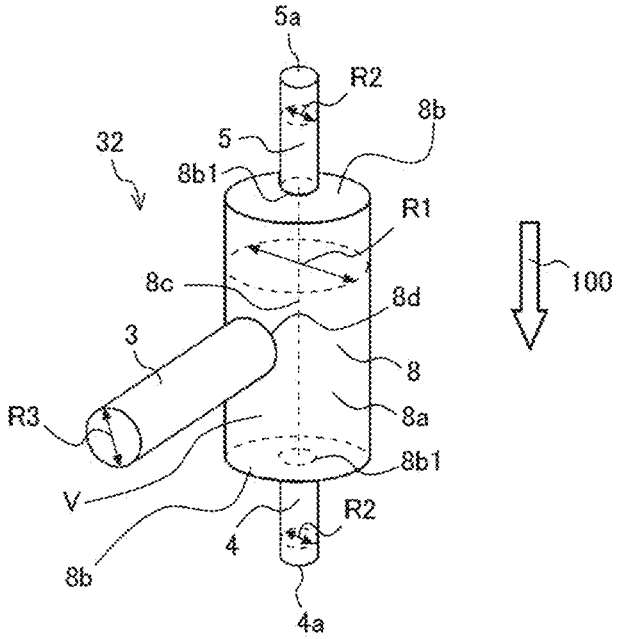
FIG. 12 is a schematic view illustrating a sixth modification of the second branching portion.

FIG. 12 is a schematic view illustrating a sixth modification of the second branching portion 32. The second branching portion 32 of the sixth modification as illustrated in FIG. 12 may be configured to have a portion in which the diameter R1 of a flow passage cross-section of part of the second branching portion 32 that is perpendicular to the direction of gravitational force 100 is larger than the diameters R2 of the liquid outflow pipe 4 and the gas outflow pipe 5.

For example, as illustrated in FIG. 12, the second branching portion 32 of the sixth modification includes an expanded portion 8 between the liquid outflow pipe 4 and the gas outflow pipe 5. The expanded portion 8 is formed in the shape of a cylinder having a space V provided therein. The expanded portion 8 includes a main body 8*a* and two lids 8*b*.

The main body 8*a* is a cylindrical member. It is preferable that the main body 8*a* of the second branching portion 32 be set such that its tube axis 8*c* extends parallel to the direction of gravitational force 100. It should be noted that although the tube axis 8*c* of the main body 8*a* may be inclined with respect to the direction of gravitational force 100, at least the tube axis 8*c* is inclined in such a range as to have a vector component in the direction of gravitational force 100.

To the main body 8*a*, the inflow pipe 3 is connected. Furthermore, the main body 8*a* has a through hole 8*d* formed therein. The through hole 8*d* is a hole that extends through the main body 8*a*. The inflow pipe 3 is connected to a portion where the through hole 8*d* is provided. The second branching portion 32 is formed such that a space in the inflow pipe 3 and the internal space V of the expanded portion 8 communicates with each other through the through hole 8*d*.

The two lids 8*b* close both ends of the main body 8*a* in the direction along the tube axis 8*c* such that the space V is provided in the main body 8*a*. The two lids 8*b* are each formed in the shape of a plate. Each of the two lids 8*b* has an opening 8*b*1. The opening 8*b*1 is a hole that extends through the lid 8*b*, To a portion forming the opening 8*b*1 of the upper one of the lids 8*b* in the direction of gravitational force 100, the gas outflow pipe 5 is connected, and to a portion forming the opening 8*b*1 of the lower one of the lids 8*b* in the direction of gravitational force 100, the liquid outflow pipe 4 is connected. That is, at the second branching portion 32, the gas outflow pipe 5 extends upward from the expanded portion 8, and the liquid outflow pipe 4 extends downward from the expanded portion 8.

The second branching portion 32 is formed such that an internal space of the gas outflow pipe 5 and the internal space V of the main body 8*a* communicate with each other through the opening 8*b*1 of the upper lid 8*b*. Furthermore, the second branching portion 32 is formed such that the internal space of the liquid outflow pipe 4 and the internal space V of the main body 8*a* communicate with each other through the opening 8*b*1 of the lower lid 8*b*.

The second branching portion 32 is formed such that the diameter R1 of a flow passage cross-section of the expanded portion 8 is larger than the diameters R2 of flow passage cross-sections of the liquid outflow pipe 4 and the gas outflow pipe 5. The diameter R1 of a flow passage cross-section of the expanded portion 8 is the inside diameter of the expanded portion 8, and the diameters R2 of flow passage cross-sections of the liquid outflow pipe 4 and the gas outflow pipe 5 are the inside diameter of the liquid outflow pipe 4 and the inside diameter of the gas outflow pipe 5.

Referring to FIG. 12, the diameters of the flow passage cross-sections of the liquid outflow pipe 4 and the gas outflow pipe 5 are the diameters R2 and are equal to each other; however, the diameters of the flow passage cross-sections of the liquid outflow pipe 4 and the gas outflow pipe 5 may be different from each other. However, the diameters of flow passage cross-sections of the liquid outflow pipe 4 and the gas outflow pipe 5 are smaller than the diameter of the flow passage cross-section of the expanded portion 8. That is, the diameter of the flow passage cross-section of the expanded portion 8 is larger than the diameters of the flow passage cross-sections of the liquid outflow pipe 4 and the gas outflow pipe 5.

Furthermore, the second branching portion 32 is formed such that the diameter R1 of the flow passage cross-section of the expanded portion 8 is larger than the diameter R3 of the flow passage cross-section of the inflow pipe 3. It should be noted that the diameter R3 of the flow passage cross-section of the inflow pipe 3 is the inside diameter of the inflow pipe 3.

In the second branching portion 32 of the sixth modification, the diameter of the flow passage cross-section of the expanded portion 8 is larger than the diameters of the flow passage cross-sections of the liquid outflow pipe 4 and the gas outflow pipe 5. Furthermore, the second branching portion 32 of the sixth modification is formed such that the diameter of the flow passage cross-section of the expanded portion 8 is larger than the diameter of the flow passage cross-section of the inflow pipe 3. By virtue of the above configuration, the second branching portion 32 of the sixth modification can be a positive-displacement gas-liquid separator and can obtain a greater gas-liquid separation effect than in the case where the second branching portion 32 does not have such a configuration. The positive-displacement gas-liquid separator is a gas-liquid separator having a structural portion of the second branching portion 32 that is larger in pipe diameter than inlet and outlet pipes such as the inflow pipe 3, the liquid outflow pipe 4, and the gas outflow pipe 5. In the second branching portion 32 of the sixth modification, the structural portion having a larger pipe diameter than inlet and outlet pipes such as the inflow pipe 3, the liquid outflow pipe 4, and the gas outflow pipe 5 is the expanded portion 8.

The second branching portion 32 of the sixth modification has the expanded portion 8 and can thus improve separation between liquid main refrigerant and gas main refrigerant. More particularly, the flow velocity of refrigerant that has flowed from the inflow pipe 3 into the expanded portion 8 is reduced since the expanded portion 8 has a larger cross-sectional area than the inflow pipe 3, and in addition, two-phase gas-liquid refrigerant collides with, for example, an inner wall or other parts of the expanded portion 8. Of the refrigerant that has been reduced in flow velocity and collided with, for example, the inner wall of the expanded portion 8, a liquid-phase refrigerant component falls and flows out of the second branching portion 32 through the liquid outflow pipe 4, and the remaining gas-phase refrigerant component is separated in such a manner as to flow out from the gas outflow pipe 5 which is located above the liquid outflow pipe 4.

As the cross-sectional area of the flow passage is larger and the flow velocity of the refrigerant is reduced, the effect of a force other than an inertial force by which gas refrigerant and liquid refrigerant are mixed and flow in the same direction becomes greater, that is, the effect of gravity in this case become greater, and of the two-phase gas-liquid refrigerant mixture, gas refrigerant and liquid refrigerant are easily separated from each other in opposite directions of an up-down direction.

Furthermore, in the second branching portion 32 of the sixth modification, regarding separation of the gas refrigerant and the liquid refrigerant of the refrigerant, the gas refrigerant and the liquid refrigerant can be separated from each other by gravity and also by a centrifugal force which is generated by rotating the refrigerant in the expanded portion 8.

In addition, in the second branching portion 32 of the sixth modification, the expanded portion 8 has a larger inside diameter than the inflow pipe 3, the liquid outflow pipe 4, and the gas outflow pipe 5 and a larger surface area than the inflow pipe 3, the liquid outflow pipe 4, and the gas outflow pipe 5. Regarding separation of the gas refrigerant and the liquid refrigerant of the refrigerant, the second branching portion 32 of the sixth modification can utilize separation due to gravity, and, for example, the surface tension of the expanded portion 8 which has a larger surface area than the inflow pipe 3, the liquid outflow pipe 4, and the gas outflow pipe 5.

In the refrigeration cycle apparatus 200, gas main refrigerant is supplied to the fourth branching portion 34, which is provided as a branching portion closer to the compressor 14 than the third branching portion 33, to thereby prevent liquid refrigerant from flowing into the compressor 14. Thus, the refrigeration cycle apparatus 200 provides a higher performance.

Advantages of Embodiment 1

As described above, the refrigeration cycle apparatus 200 of Embodiment 1 is configured such that the refrigerant flowing through the bypass circuit 20*b* branches off at the second branching portion 32 into the liquid main refrigerant 61 and the gas main refrigerant 62. Moreover, the refrigeration cycle apparatus 200 is configured such that the refrigerants into which the refrigerant branches off in the bypass circuit 20*b* join a main flow flowing through the main circuit 20*a* at the third and fourth branching portions 33 and 34 of the main circuit 20*a*. In the refrigeration cycle apparatus 200 according to Embodiment 1 as illustrated in FIGS. 1 and 2, the refrigerant tank 6 is provided between the third branching portion 33 and the fourth branching portion 34. In the refrigeration cycle apparatus, the refrigerant that has joined the liquid main refrigerant 61 at the third branching portion 33 is subjected to phase separation in the refrigerant tank 6, and the refrigerant that has flowed out from the refrigerant tank 6 joins the gas main refrigerant 62 at the fourth branching portion 34 and is supplied to the compressor 14.

The refrigeration cycle apparatus 200 includes the second branching portion 32. The second branching portion 32 includes the liquid outflow pipe 4 which forms an outlet for the refrigerant that is located below the gas outflow pipe 5, and the gas outflow pipe 5 which forms an outlet for the refrigerant that is located above the liquid outflow pipe 4. The second branching portion 32 bifurcates the refrigerant. The second branching portion 32 includes the gas outflow pipe 5 and the liquid outflow pipe 4, which are arranged one above the other in the direction of gravitational force, and separates two-phase gas-liquid refrigerant into the gas main refrigerant 62 which flows through the gas outflow pipe 5 and the liquid main refrigerant 61 which flows through the liquid outflow pipe 4, the liquid main refrigerant 61 having a lower quality than the gas main refrigerant 62. The refrigeration cycle apparatus 200 supplies each of these separated refrigerants to part of the main circuit 20*a* that is located from the indoor heat exchanger 16, which operates as the first evaporator, to the discharge outlet 14*b* of the compressor 14. Therefore, the refrigeration cycle apparatus 200 can increase the flow rate of refrigerant in the bypass circuit 20*b* without excessively supplying liquid refrigerant to the suction inlet 14*a* of the compressor 14. Thus, in the refrigeration cycle apparatus 200, it is possible to improve the performance of the compressor and the energy saving performance without increasing the sizes of devices and ensure a sufficient performance of the compressor and a sufficient energy saving performance and a space required for installation of the devices.

Figure 13:
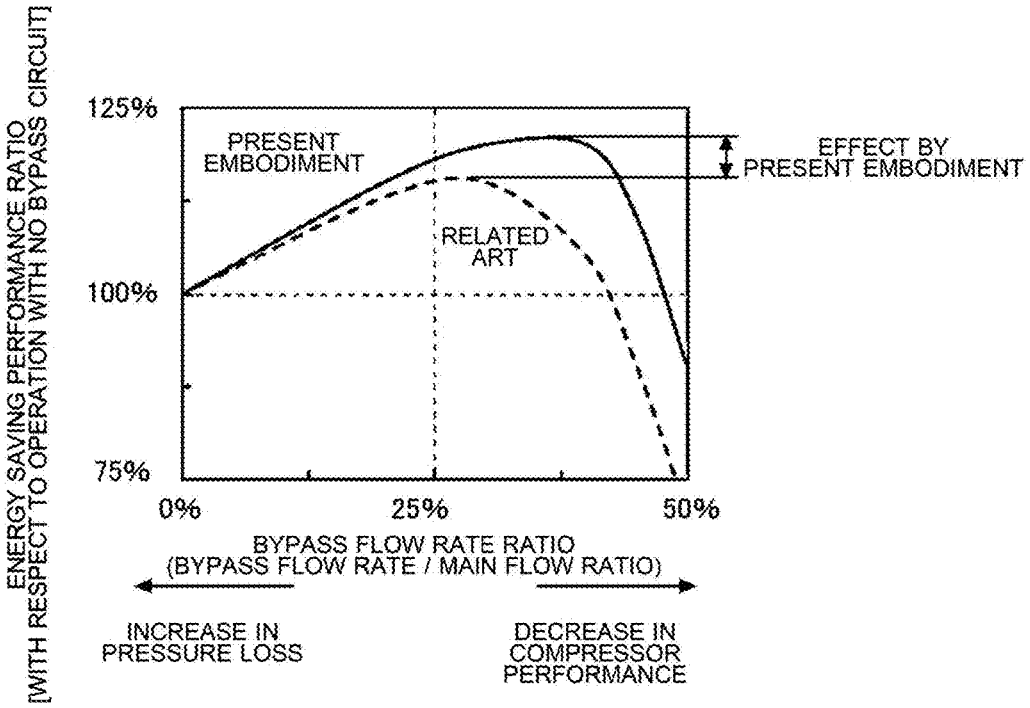
FIG. 13 is a graph conceptually comparing an energy saving performance ratio with a bypass flow rate ratio of the refrigeration cycle apparatus.

FIG. 13 is a graph conceptually comparing an energy saving performance ratio with a bypass flow rate ratio of the refrigeration cycle apparatus. In FIG. 13, the horizontal axis represents a bypass flow rate ratio, and the vertical axis represents the energy saving performance ratio with respect to an operation performed without a bypass circuit. It should be noted that the bypass flow rate ratio represents the ratio of a bypass flow rate to the main flow rate. The main flow rate is the flow rate of the refrigerant that flows through the main circuit 20*a*, and the bypass flow rate is the flow rate of the refrigerant that flows through the bypass circuit 20*b*. The refrigeration cycle apparatus is configured such that the performance of the compressor degrades as the bypass flow rate ratio approaches 50%, and a pressure loss increases as the bypass flow rate ratio approaches 0%.

Figure 14:
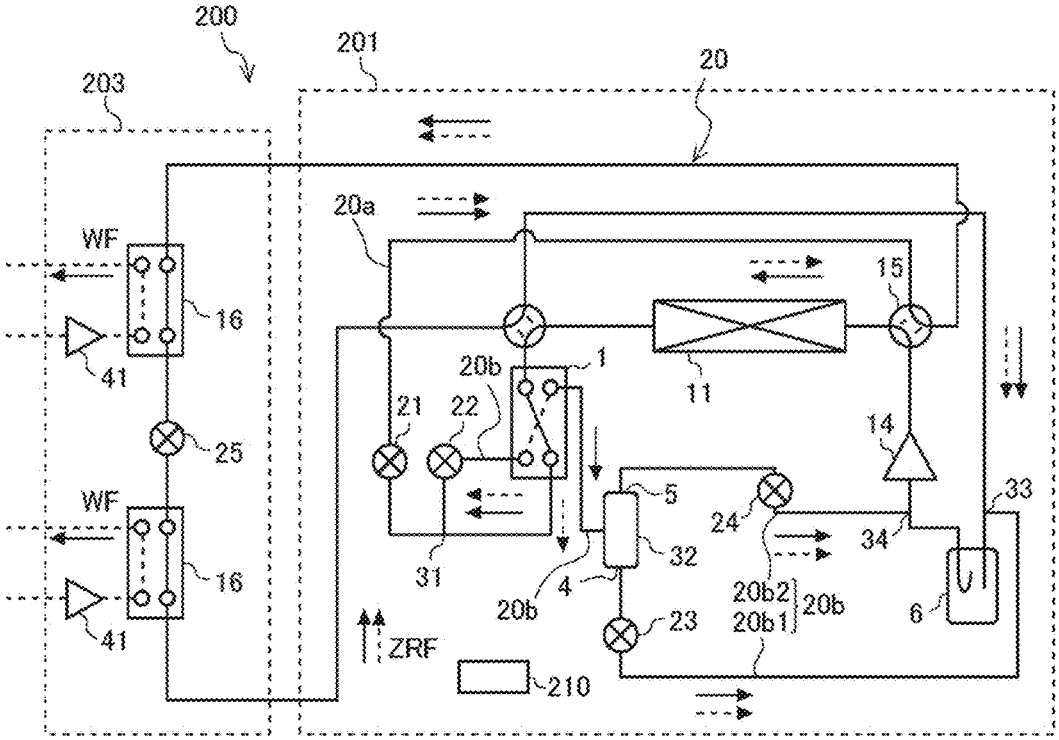
FIG. 14 is a refrigerant circuit diagram illustrating a first modification of the refrigeration cycle apparatus according to Embodiment 1.

In FIG. 14, a solid line indicates an effect of improvement of the performance of the refrigeration cycle apparatus 200 according to Embodiment 1, and a dashed line indicates the performance of an existing refrigeration cycle apparatus in which gas-liquid separation is not performed at a second branching portion 32 and which includes devices having the same sizes as those of corresponding devices of the refrigeration cycle apparatus 200 according to Embodiment 1.

Advantages of the refrigeration cycle apparatus 200 according to Embodiment 1 will be described with reference to FIG. 13. In general, when liquid main refrigerant flows into a compressor, liquid compression occurs in the compressor and the performance of the compressor is degraded, thus causing a failure in a device or devices. In view of this problem, in some cases, a refrigerant tank that is connected to a suction side of the compressor may be made larger in order that refrigerant that is supplied to the compressor is sufficiently subjected to phase separation.

In the refrigeration cycle apparatus 200 according to Embodiment 1, the gas main refrigerant 62 flows to the fourth branching portion 34. Furthermore, the refrigeration cycle apparatus 200 is configured such that at the second branching portion 32, the liquid main refrigerant 61 and the gas main refrigerant 62 are separated from each other, and the liquid main refrigerant 61 is made to pass through the refrigerant tank 6, whereby liquid refrigerant is removed from the liquid main refrigerant 61 and the resultant refrigerant then joins the gas main refrigerant 62 at the fourth branching portion 34. Therefore, in the refrigeration cycle apparatus 200, the liquid flow rate of refrigerant that is supplied to the compressor 14 per liquid refrigerant that is let out from the refrigerant tank 6 is reduced, and it is not necessary to increase the size of the refrigerant tank 6. Furthermore, the refrigeration cycle apparatus 200 can improve the performance by increasing the flow rate of the refrigerant that flows through the bypass circuit 20*b* and reducing a pressure loss caused by the refrigerant that flows through the main circuit 20*a*.

Furthermore, as long as the fourth branching portion 34 is situated downstream of the third branching portion 33, a certain volume is provided between the third branching portion 33 and the fourth branching portion 34, and therefore, especially during a low-load operation whose circulating volume is small, liquid stays in a low-pressure pipe. In the refrigeration cycle apparatus 200 according to Embodiment 1, since liquid stays in the low-pressure pipe and gas main refrigerant flows into the compressor 14, the performance is improved, as compared with a configuration in which liquid refrigerant flows directly into a compressor.

As indicated by the dashed line in FIG. 13, in the existing refrigeration cycle apparatus, when the bypass flow rate is increased from a bypass flow of 0%, at the beginning, a pressure loss of a main flow of the refrigerant, especially a refrigerant pressure difference from an outlet of an evaporator to a suction of a compressor, is reduced, and the performance is improved. In the existing refrigeration cycle apparatus, when a certain amount of refrigerant is made to flow to a bypass circuit, a bypass flow of refrigerant flowing through the bypass circuit is not sufficiently subjected to heat exchange, and thus joins, in a two-phase gas-liquid state, the main flow of refrigerant that flows through a main circuit. Therefore, in the existing refrigeration cycle apparatus, a heat loss and the amount of liquid refrigerant that is supplied to the compressor are increased, as a result of which the performance of the compressor is reduced and the efficiency in saving energy is also reduced.

As indicated by the solid line in FIG. 13, in the refrigeration cycle apparatus 200, the amount of liquid refrigerant that is supplied to the compressor 14 is reduced, the bypass flow rate is made higher than in the existing cycle apparatus, and the energy saving performance can be improved. To be more specific, in the refrigeration cycle apparatus 200, the refrigerant tank 6 is provided between the third branching portion 33 and the fourth branching portion 34. Therefore, in the refrigeration cycle apparatus 200, the flow rate of refrigerant that flows out from the refrigerant tank 6 is reduced, and the amount of liquid refrigerant that is mixed in by the inertial force of refrigerant and the swinging of the surface of a liquid in the refrigerant tank 6 is reduced, as compared with the case where the fourth branching portion 34 is provided. Moreover, the flow rate of refrigerant is reduced, and the gas main refrigerant 62 joins, at the fourth branching portion 34, refrigerant that flows out from the refrigerant tank 6 in which the flow rate of the refrigerant is reduced, whereby the amount of liquid refrigerant that is supplied to the compressor 14 is reduced.

Furthermore, in the refrigeration cycle apparatus 200, which is capable of performing switching between cooling and heating, when switching between cooling and heating is performed, the outdoor heat exchanger 11 and the indoor heat exchangers 16 operate as an evaporator and a condenser By virtue of the above configuration, in the refrigeration cycle apparatus 200, when the above heat exchangers operate as an evaporator and a condenser, it is possible to cause the flow rate of refrigerant in a condenser operation to be higher than the flow rate of refrigerant in an evaporator operation. Therefore, in the refrigeration cycle apparatus 200, it is possible to improve an in-tube heat transfer in the condenser operation per pressure loss of refrigerant in the evaporator operation, and thus improve both the performance in the cooling operation and that in the heating operation.

Furthermore, by virtue of the above configuration, in the refrigeration cycle apparatus 200, it is possible to increase the flow rate adjustment range of the bypass flow of refrigerant that flows through the bypass circuit 20*b*. In the refrigeration cycle apparatus 200, it is possible to increase the flow rate adjustment range of the bypass flow of refrigerant that flows through the bypass circuit 20*b*, and thus to reduce a difference between the flow rate of refrigerant that flows through an evaporator with a cooling and heating capacity of 100% of the devices and the flow rate of refrigerant with a cooling and heating capacity of 100% or lower of the devices, especially a cooling and heating capacity of 25% to 80%. In the refrigeration cycle apparatus 200, since it is possible to reduce the difference between the flow rates of the refrigerant that is made due to the difference between the cooling and heating capacities of the devices, it is possible to reduce a flow rate design range of devices whose performances greatly depend on the flow velocity of the refrigerant. As the devices whose performances greatly depend on the flow velocity of the refrigerant, for example, the outdoor heat exchanger 11, the indoor heat exchanger 16, and the refrigerant tank 6 are present. In the refrigeration cycle apparatus 200, since it is possible to reduce the flow rate design range of components of the devices whose performances greatly depend on the flow velocity of refrigerant, it is possible to improve the performance of an intermediate load operation and improve the periodic efficiency of the refrigeration cycle apparatus 200, in which operation loads vary throughout the year.

It should be noted that although the bypass flow rate ratio and a performance improvement rate at which the performance is maximized vary depending on the operation capacity for the sizes of devices or on the refrigerant kind of a working fluid, the effect of improvement in energy saving performance at an operating point at which the bypass flow rate is higher than in the existing refrigeration cycle apparatus does not vary depending on the operation capacity for the sizes of the devices or on the refrigerant kind of the working fluid. For example, the performance improvement effect is great in a device including a long extension pipe that is provided to extend from an outdoor unit to an indoor unit or a device having a high operation capacity.

Furthermore, a working fluid that at least partially contains refrigerant that is lower in gas density than R32 refrigerant is high in refrigerant flow velocity per capacity and thus obtains a great performance improvement effect because of reduction of a pressure loss. The refrigerant which flows in the main circuit 20*a* and the bypass circuit 20*b* is refrigerant that is lower in gas density than R32 refrigerant. This refrigerant is, for example, refrigerant that contains any one or more of olefin-based refrigerant such as tetrafluoropropane, ethylene-based refrigerant such as difluoroethylene, ethane-based refrigerant such as tetrafluoroethane, propane, and dimethyl ether (DME). It should be noted that the olefin-based refrigerant is, for example, HFO1234yf or HFO1234ze(E).

Furthermore, in the case where the working fluid is a zeotropic refrigerant mixture of at least two kinds of refrigerants whose normal boiling points differ from each other by 1 degree C. or more, the main flow of refrigerant that flows in the main circuit 20*a* joins a high-boiling-component main refrigerant at the third branching portion 33 and separates in phase at the refrigerant tank 6. Since high-boiling refrigerant is stored as liquid refrigerant in the refrigerant tank 6 and low-boiling main refrigerant flows into the compressor 14, low-boiling-component main refrigerant circulates through the refrigerant flow passage 20, and the performance of the refrigeration cycle apparatus 200 is improved.

Figure 15:
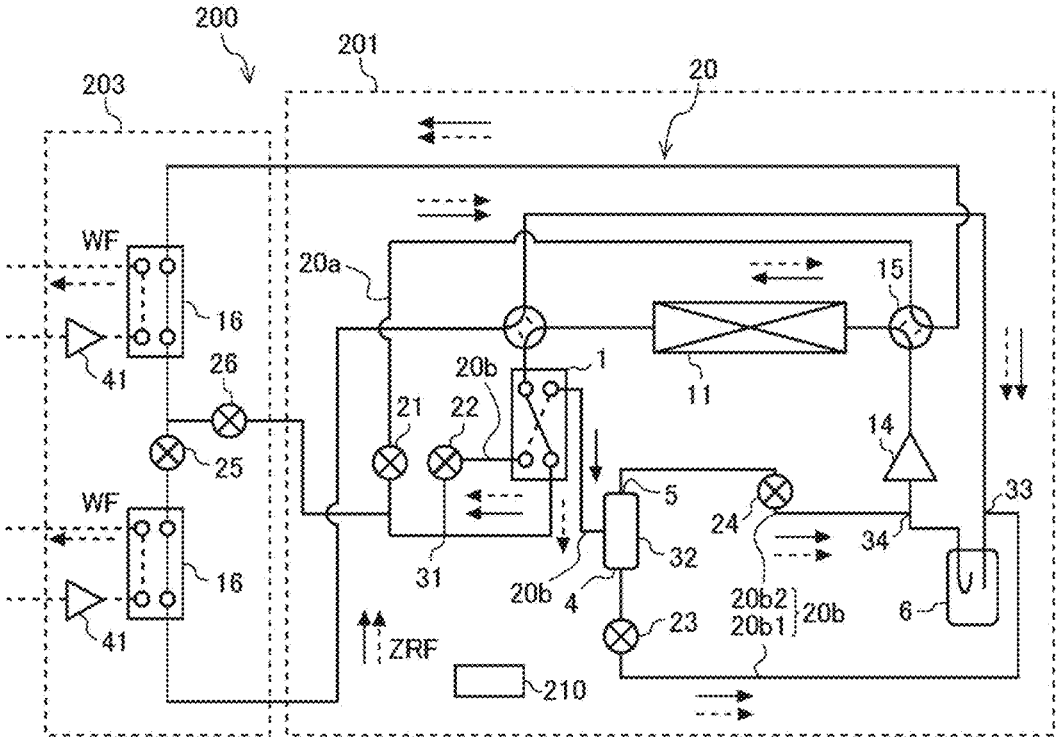
FIG. 15 is a refrigerant circuit diagram illustrating a second modification of the refrigeration cycle apparatus according to Embodiment 1.

FIG. 14 is a refrigerant circuit diagram illustrating a first modification of the refrigeration cycle apparatus 200 according to Embodiment 1. FIG. 15 is a refrigerant circuit diagram illustrating a second modification of the refrigeration cycle apparatus 200 according to Embodiment 1. FIGS. 14 and 15 illustrate the modifications of the refrigeration cycle apparatus 200. In FIGS. 14 and 15, solid arrows and dashed arrows indicate the flow direction of the refrigerant RF, particularly the flow of a zeotropic refrigerant mixture ZRF. Furthermore, in FIGS. 14 and 15, dotted arrows in a relay unit 203 indicate the flow of water WF.

Each of the refrigeration cycle apparatuses 200 as illustrated in FIGS. 14 and 15 includes a fifth expansion device 25 that is provided between two indoor heat exchangers 16. Furthermore, the refrigeration cycle apparatus 200 as illustrated in FIG. 15 includes a sixth expansion device 26 that is provided at a pipe provided to connect a pipe between the fifth expansion device 25 and an indoor heat exchanger 16 with a pipe between the first refrigerant-to-refrigerant heat exchanger 1 and the first expansion device 21. It should be noted that the fifth expansion device 25 and the sixth expansion device 26 operate as pressure reducing valves or expansion valves that expand and decompress refrigerant, and may be similar in configuration to the first expansion device 21 and the second expansion device 22.

As illustrated in FIGS. 14 and 15, the indoor heat exchangers 16 may be a relay unit 203 that transfers a heat medium to the indoor unit 202. Furthermore, the numbers of outdoor units 201, indoor units 202 (see FIGS. 1 and 2), and relay units 203 may be larger than or equal to 2. Furthermore, the outdoor unit 201, the indoor unit 202 (see FIGS. 1 and 2), and the relay unit 203 may be connected in series or in parallel in the flow direction of refrigerant.

Furthermore, in the outdoor unit 201, the outdoor heat exchanger 11 is provided, and in the indoor unit 202, the indoor heat exchanger 16 is provided (see FIGS. 1 and 2), or in the relay unit 203, the indoor heat exchanger 16 is provided. Furthermore, in the indoor unit 202, a second indoor heat exchanger 12 or a third indoor heat exchanger 17 may be provided (see FIGS. 22 and 23). The outdoor heat exchanger 11, the second indoor heat exchanger 12, the indoor heat exchangers 16, and the third indoor heat exchanger 17 may be connected in series or in parallel in the flow direction of refrigerant.

Embodiment 2

Configuration in Embodiment 2

Figure 16:
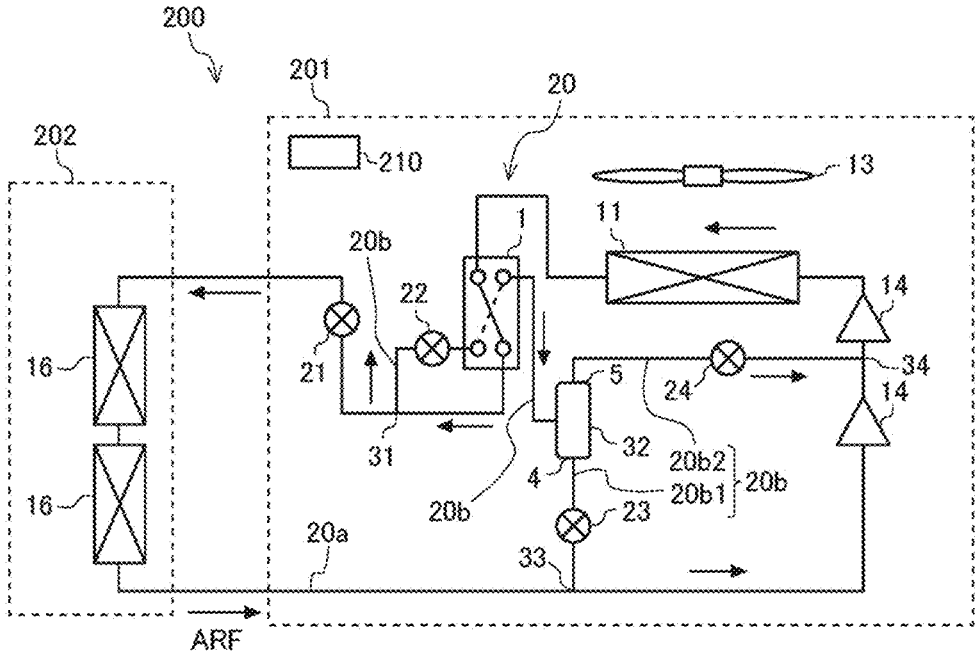
FIG. 16 is a schematic view illustrating a refrigeration cycle apparatus according to Embodiment 2.

FIG. 16 is a schematic view illustrating a refrigeration cycle apparatus 200 according to Embodiment 2. In FIG. 16, solid arrows indicate the flow direction of refrigerant RF, particularly the flow of single-composition refrigerant or an azeotropic refrigerant mixture ARF. Next, the refrigeration cycle apparatus 200 according to Embodiment 2 will be described with reference to FIG. 16.

The refrigeration cycle apparatus 200 according to Embodiment 2 is obtained by modifying part of the refrigeration cycle apparatus 200 according to Embodiment 1, and the basic entire configuration of the refrigeration cycle apparatus 200 according to Embodiment 2 is similar to that of the refrigeration cycle apparatus 200 of Embodiment 1, Therefore, regarding the refrigeration cycle apparatus 200 according to Embodiment 2 as illustrated in FIG. 16, components that are the same as or correspond to those of the refrigeration cycle apparatus 200 according to Embodiment 1 will be denoted by the same reference signs, and their illustrations and descriptions will be omitted.

As illustrated in FIG. 16, the refrigeration cycle apparatus 200 according to Embodiment 2 includes two compressors 14. The two compressors 14 are connected in series in the flow direction of the refrigerant. In the refrigeration cycle apparatus 200 according to Embodiment 2, the fourth branching portion 34 is provided between the two different compressors 14 which are located downstream of the third branching portion 33 in the flow direction of the refrigerant.

Advantages of Embodiment 2

In the refrigeration cycle apparatus 200, the fourth branching portion 34 which is connected to the gas outflow pipe 5 is provided at a refrigerant compression stage, whereby the gas ratio of refrigerant that is supplied to one of the compressors 14 which is downstream of the fourth branching portion 34 is increased. In general, when liquid main refrigerant flows into a compressor, liquid compression occurs in the compressor and the performance of the compressor is degraded. Therefore, as a measure against such a problem, for example, a device or devices such as a refrigerant tank or a preheating structure may be added to the refrigeration cycle apparatus. In the refrigeration cycle apparatus 200 according to Embodiment 2, the main flow of refrigerant that flows in the main circuit 20*a* joins the gas main refrigerant 62 at the fourth branching portion 34. Therefore, in the refrigeration cycle apparatus 200, it is possible to reduce, without adding a device or devices, the flow rate of liquid that is supplied to the refrigerant compression stage. Furthermore, in the refrigeration cycle apparatus 200, it is possible to increase the bypass flow rate and reduce a pressure loss of the main flow, thereby improving the performance.

Configuration of Modification of Embodiment 2

Figure 17:
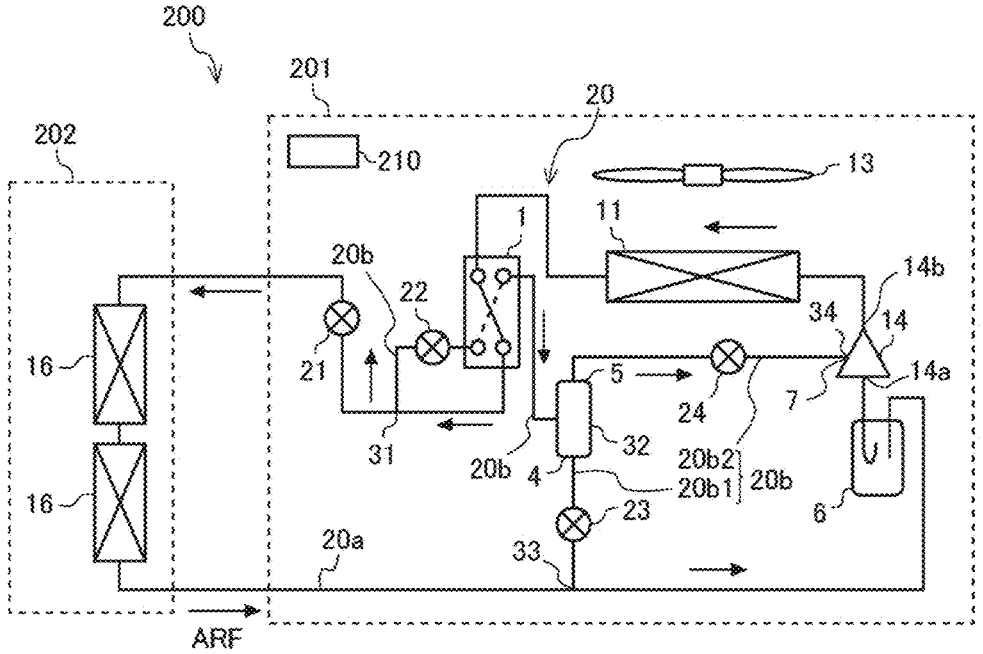
FIG. 17 illustrates a modification of the refrigeration cycle apparatus according to Embodiment 2.

FIG. 17 illustrates a modification of the refrigeration cycle apparatus 200 according to Embodiment 2. In FIG. 17, solid arrows indicate the flow direction of refrigerant RF, particularly the flow of single-composition refrigerant or an azeotropic refrigerant mixture ARF. In the refrigerant flow passage 20, one of the compressor 14 that is located upstream of the fourth branching portion 34 and the other compressor 14 which is located downstream of the fourth branching portion 34 as illustrated in FIG. 16 may be combined into a single compressor 14. Moreover, the fourth branching portion 34 may be formed as an injection port 7 of the compressor 14.

The injection port 7 is formed to communicate with a compression chamber (not illustrated) of the compressor 14. The injection port 7 is a through hole formed in the compressor 14, and is used to forcibly inject two-phase gas-liquid refrigerant or other refrigerant into the compression chamber of the compressor 14. The injection port 7 is, for example, an intermediate-pressure injection port that communicates with part of the compression chamber that is set at an intermediate pressure.

Advantages of Modification of Embodiment 2

In the refrigeration cycle apparatus 200, the fourth branching portion 34 which is connected to the gas outflow pipe 5 is provided at a refrigerant compression stage, whereby the gas ratio of refrigerant that is supplied to the compressor 14 through the injection port 7 is increased. In general, when liquid main refrigerant flows into a compressor, liquid compression occurs in the compressor, thereby degrading the performance of the compressor. Thus, as a countermeasure against such a problem, a device or devices such as a refrigerant tank or a preheating structure may be added to the refrigeration cycle apparatus. In the refrigeration cycle apparatus 200 according to Embodiment 2, the main flow of refrigerant that flows in the main circuit 20*a* joins the gas main refrigerant 62 at the fourth branching portion 34. Therefore, in the refrigeration cycle apparatus 200, it is possible to reduce, without adding a device or devices, reduce the flow rate of liquid that is supplied to the refrigerant compression stage. Furthermore, in the refrigeration cycle apparatus 200, it is possible to increase the bypass flow rate and reduce a pressure loss of the main flow, thereby improving the performance.

Furthermore, in general, when liquid refrigerant flows into an injection port, it reduces the airtightness of a compression chamber and degrades the performance of a compressor. Therefore, in a refrigerant cycle apparatus, a device or devices such as a refrigerant tank or a preheating structure may be additionally provided upstream of the injection port. In the refrigeration cycle apparatus 200 according to Embodiment 2 as illustrated in FIG. 17, the gas main refrigerant 62 is supplied to the injection port 7 through the gas outflow pipe 5 of the second branching portion 32. Therefore, in the refrigeration cycle apparatus 200, it is possible to reduce the flow rate of liquid that is supplied to the refrigerant compression stage, and to increase the bypass flow rate, without adding a device or devices, and reduce a pressure loss of the main flow, thereby improving the performance.

Furthermore, in the case where the working fluid is single-composition refrigerant or an azeotropic refrigerant mixture as in Embodiment 2, a larger number of high-boiling components flow into the low-pressure-side compressor 14 or the compression chamber (not illustrated) than in the case where the working fluid is a zeotropic refrigerant mixture. In the refrigeration cycle apparatus 200 according to Embodiment 2, since a larger number of high-boiling components flow into the low-pressure-side compressor 14 or the compression chamber (not illustrated) and degradation of the performance that would be caused by an increase in pressure loss does not occur, the performance improvement effect is great.

Embodiment 3

Configuration of Embodiment 3

Figure 18:
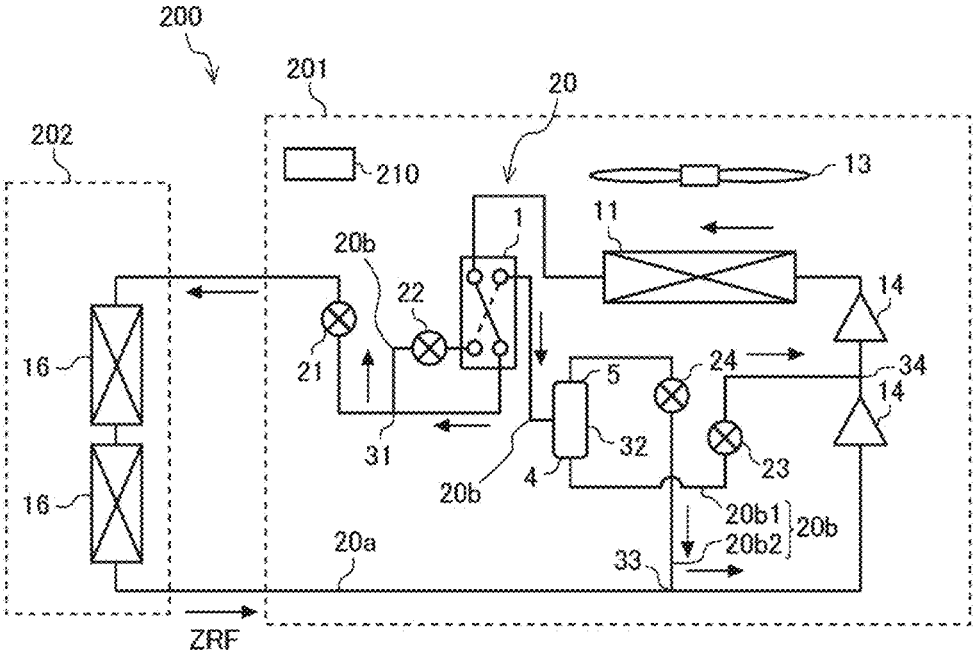
FIG. 18 is a schematic view illustrating a refrigeration cycle apparatus according to Embodiment 3.
Figure 19:
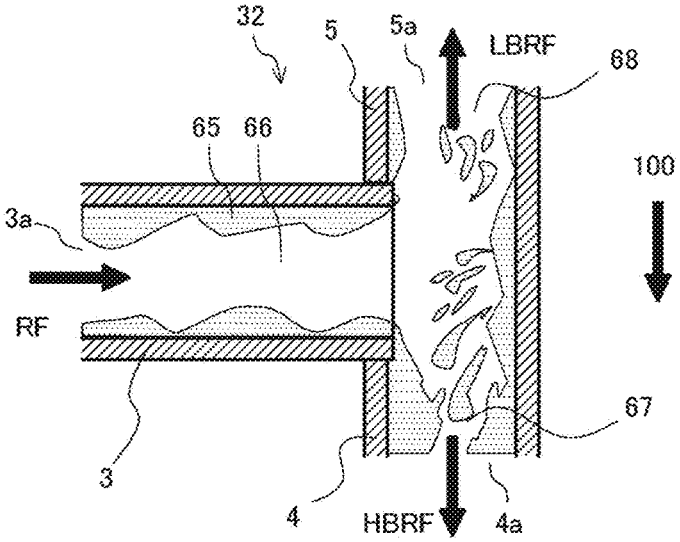
FIG. 19 is a sectional view for explanation of the flow of refrigerant at a second branching portion and schematically illustrating a section of the second branching portion.

FIG. 18 is a schematic view illustrating a refrigeration cycle apparatus 200 according to Embodiment 3. FIG. 19 is a sectional view for explanation of the flow of refrigerant at the second branching portion 32 and schematically illustrating a section of the second branching portion 32. In FIG. 18, solid arrows indicate the flow direction of refrigerant RF, particularly the flow of a zeotropic refrigerant mixture ZRF. In FIG. 19, the refrigerant flow HBRF indicates the flow of high-boiling main refrigerant 87, and the refrigerant flow LBRF indicates the flow of low-boiling main refrigerant 68. Furthermore, for viewability, in FIG. 18, illustration of part of the refrigerant flow passage 20 that is used in the heating operation is omitted, and part of the refrigerant flow passage 20 that is used in the cooling operation is illustrated. Next, the refrigeration cycle apparatus 200 according to Embodiment 3 will be described with reference to FIGS. 18 and 19.

The refrigeration cycle apparatus 200 according to Embodiment 3 is obtained by modifying part of the refrigeration cycle apparatus 200 according to Embodiment 1, and the basic entire configuration of the refrigeration cycle apparatus 200 according to Embodiment 3 is similar to that of the refrigeration cycle apparatus 200 of Embodiment 1. Therefore, regarding the refrigeration cycle apparatus 200 according to Embodiment 3 as illustrated in FIG. 18, components that are the same as correspond to those of the refrigeration cycle apparatus 200 according to Embodiment 1 will be denoted by the same reference signs, and their illustrations and their descriptions will thus be omitted.

In the refrigeration cycle apparatus 200 according to Embodiment 3, the working fluid is a zeotropic refrigerant mixture of at least two kinds of refrigerants whose normal boiling points differ from each other by 1 degree C. or more. As illustrated in FIG. 18, in the refrigeration cycle apparatus 200 according to Embodiment 3, the gas outflow pipe 5 of the second branching portion 32 is connected to the third branching portion 33, and the liquid outflow pipe 4 is connected to the fourth branching portion 34.

In the refrigeration cycle apparatus 200 according to Embodiment 3 as illustrated in FIG. 18, the first branch passage 20*b*1 is a flow passage that connects the liquid outflow pipe 4 of the second branching portion 32 and the fourth branching portion 34. In the first branch passage 20*b*1, the third expansion device 23 is provided. In the refrigeration cycle apparatus 200 according to Embodiment 3 as illustrated in FIG. 18, the second branch passage 20*b*2 is a flow passage that connects the gas outflow pipe 5 of the second branching portion 32 and the third branching portion 33. In the second branch passage 20*b*2, the fourth expansion device 24 is provided.

In the refrigeration cycle apparatus 200 according to Embodiment 3 as illustrated in FIG. 18, at the third branching portion 33, the second branch passage 20*b*2 of the bypass circuit 20*b* and the main circuit 20*a* are connected. At the third branching portion 33, refrigerant that flows through the second branch passage 20*b*2 of the bypass circuit 20*b* flows into the main circuit 20*a*. In the refrigeration cycle apparatus 200 according to Embodiment 3 as illustrated in FIG. 18, the fourth branching portion 34 is provided between the third branching portion 33 and the downstream one of the two compressors 14.

In the refrigeration cycle apparatus 200 according to Embodiment 3 as illustrated in FIG. 18, at the fourth branching portion 34, the first branch passage 20*b*1 of the bypass circuit 20*b* and the main circuit 20*a* are connected. At the fourth branching portion 34, refrigerant that flows through the first branch passage 20*b*1 of the bypass circuit 20*b* flows into the main circuit 20*a*. In the refrigeration cycle apparatus 200 according to Embodiment 3 as illustrated in FIG. 18, the fourth branching portion 34 is provided between the compressors 14 and the third branching portion 33.

In the refrigeration cycle apparatus 200 according to Embodiment 3, as illustrated in FIG. 18, the fourth branching portion 34 is provided between the two different compressors 14 located downstream of the third branching portion 33.

Advantages of Embodiment 3

In general, in a refrigeration cycle apparatus using a zeotropic refrigerant mixture as a working fluid, when refrigerant containing a large amount of high-boiling refrigerant flows into a low-pressure suction inlet of a compressor, a pressure loss and a volumetric flow rate at the suction inlet of the compressor increase. Therefore, in order to maintain the performance of the refrigeration cycle apparatus, the compressor may be made larger to increase the capacity thereof, or a refrigerant tank may be made larger in order that the high-boiling refrigerant be stored in the refrigerant tank.

In the refrigeration cycle apparatus 200 according to Embodiment 3, a two-phase azeotropic refrigerant mixture (bypass flow) that flows in the bypass circuit 20*b* separates at the second branching portion 32. At this time, as illustrated in FIG. 19, of the refrigerant RF which flows into the second branching portion 32, liquid refrigerant 65 contains a large number of high-boiling components, and gas refrigerant 66 contains a large number of low-boiling components. Therefore, a larger amount of high-boiling main refrigerant 67 flows out from the outlet 4*a* of the liquid outflow pipe 4 than from the outlet 5*a* of the gas outflow pipe 5, and a larger amount of low-boiling main refrigerant 68 flows out from the outlet 5*a* of the gas outflow pipe 5 than from the outlet 4*a* of the liquid outflow pipe 4.

The high-boiling main refrigerant 67 is refrigerant containing a large amount of liquid refrigerant 65 that is relatively high in density and is refrigerant containing a large number of high-boiling components. The low-boiling main refrigerant 68 is refrigerant containing a large amount of gas refrigerant 66 that is relatively low in density, and is refrigerant containing a large number of low-boiling components. The high-boiling main refrigerant 67 which flows out from the outlet 4*a* of the liquid outflow pipe 4 is supplied to the fourth branching portion 34, and the low-boiling main refrigerant 68 which flows out from the outlet 5*a* of the gas outflow pipe 5 is supplied to the third branching portion 33.

At this time, in the refrigeration cycle apparatus 200, the pressure at the position of the third branching portion 33 is lower than that at the position of the fourth branching portion 34. In the refrigeration cycle apparatus 200 according to Embodiment 3, the low-boiling main refrigerant 68 is supplied to the third branching portion 33, whereby the low-boiling main refrigerant 68 is supplied to a low-pressure side one of the compressors 14, and the high-boiling main refrigerant 67 is supplied to the fourth branching portion 34, whereby the high-boiling main refrigerant 67 is supplied to a high-pressure side one of the compressors 14.

By virtue of the above configuration, in the refrigeration cycle apparatus 200 according to Embodiment 3, it is possible to reduce an increase in pressure loss of the low-pressure-side compressor 14 and improve the energy saving performance without increasing the sizes of the devices. Furthermore, in the case where the difference in temperature between refrigerants contained in the refrigerant mixture for use in the refrigeration cycle apparatus 200 is 5 degrees C. or greater, gas-phase separation brings about a greater compositional separation effect, and particularly the performance is thus greatly improved.

Configuration of Modification of Embodiment 3

Figure 20:
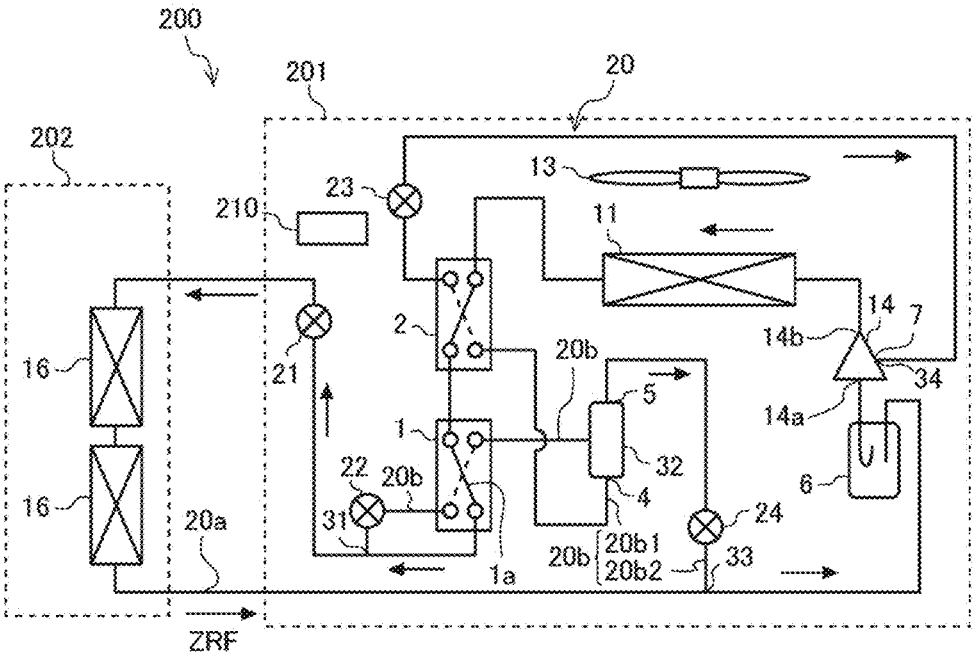
FIG. 20 is a schematic view illustrating a first modification of the refrigeration cycle apparatus according to Embodiment 3.
Figure 21:
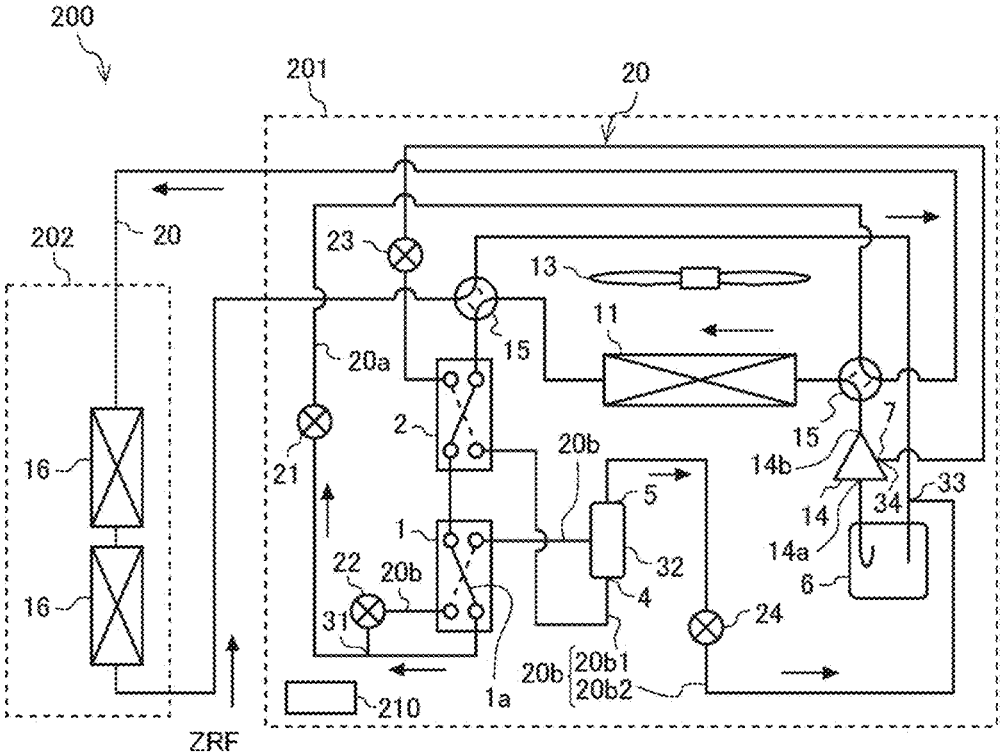
FIG. 21 is a schematic view illustrating a second modification of the refrigeration cycle apparatus according to Embodiment 3.

FIG. 20 is a schematic view illustrating a first modification of the refrigeration cycle apparatus 200 according to Embodiment 3. FIG. 21 is a schematic view illustrating a second modification of the refrigeration cycle apparatus 200 according to Embodiment 3. In FIGS. 20 and 21, solid arrows indicate the flow direction of refrigerant RF, particularly the flow of a zeotropic refrigerant mixture ZRF. Furthermore, for viewability, In FIG. 20, part of the refrigerant flow passage 20 that is used in the heating operation is omitted, and part of the refrigerant flow passage 20 is used in the cooling operation is illustrated.

In each of the refrigeration cycle apparatuses 200 of the first modification and the second modification, a zeotropic refrigerant mixture of at least two kinds of refrigerants whose normal boiling points differ from each other by 1 degree C. or is used as the working fluid. As illustrated in FIGS. 20 and 21, in the refrigeration cycle apparatus 200 of each of the first modification and the second modification, the gas outflow pipe 5 is connected to the third branching portion 33, and the liquid outflow pipe 4 is connected to the fourth branching portion 34. In the refrigeration cycle apparatus 200 of each of the first modification and the second modification, the fourth branching portion 34 is an injection port 7 of the compressor 14.

The refrigeration cycle apparatus 200 of each of the first and second modifications includes a second refrigerant-to-refrigerant heat exchanger 2. In the second refrigerant-to-refrigerant heat exchanger 2, two flow passages that allow refrigerant to flow therethrough are provided as in the first refrigerant-to-refrigerant heat exchanger 1. The second refrigerant-to-refrigerant heat exchanger 2 causes heat exchange to be performed between refrigerant that flows through a flow passage extending from the outdoor heat exchanger 11 of the main circuit 20*a* to the first expansion device 21 and refrigerant that flows through a flow passage extending from the liquid outflow pipe 4 to the fourth branching portion 34. It should be noted that the outdoor heat exchanger 11 is the first condenser.

In both the cooling operation and the heating operation, the first refrigerant-to-refrigerant heat exchanger 1 is located downstream of the second refrigerant-to-refrigerant heat exchanger 2 in the flow direction of refrigerant that flows through the high-temperature-side flow passages 1*a* of the first refrigerant-to-refrigerant heat exchanger 1, In the refrigeration cycle apparatus 200 of each of the first and second modifications, the opening degree of the fourth expansion device 24 provided between the second branching portion 32 and the third branching portion 33 is adjusted to control a heat exchange amount ratio between the first refrigerant-to-refrigerant heat exchanger 1 and the second refrigerant-to-refrigerant heat exchanger 2. It should be noted that the first refrigerant-to-refrigerant heat exchanger 1 and the second refrigerant-to-refrigerant heat exchanger 2 may be combined into a single refrigerant-to-refrigerant heat exchanger unless the low-temperature-side flow passages 1*b* of the first refrigerant-to-refrigerant heat exchanger 1 and the low-temperature-side flow passages 1*b* of the second refrigerant-to-refrigerant heat exchanger 2 are provided to join each other.

Advantages of Modification of Embodiment 3

In the refrigeration cycle apparatus 200 of the first and second modifications, the fourth branching portion 34 is located at the compression stage, and the pressure at the position of the third branching portion 33 is lower than that at the position of the fourth branching portion 34. In the refrigeration cycle apparatus 200 of each of the first and second modifications, the low-boiling main refrigerant 68 is supplied to the third branching portion 33, whereby the low-boiling main refrigerant 68 is supplied to a low-pressure side of the compressor 14; and the high-boiling main refrigerant 67 is supplied to the fourth branching portion 34, whereby the high-boiling main refrigerant 67 is supplied to a high-pressure side of the compressor 14.

By virtue of the above configuration, in the refrigeration cycle apparatus 200 of each of the first and second modification, it is possible to reduce an increase in pressure loss of the low-pressure side of the compressor 14 and improve the energy saving performance without increasing the sizes of devices. Furthermore, in the case where a temperature difference between refrigerants contained in the refrigerant mixture for use in the refrigeration cycle apparatus 200 is 5 degrees C. or greater, gas-phase separation brings about a greater compositional separation effect, and in particular, the performance is greatly improved.

Furthermore, in the refrigeration cycle apparatus 200 of each of the first and second modifications, the second refrigerant-to-refrigerant heat exchanger 2 is provided, and the high-boiling main refrigerant 67, which is the liquid main refrigerant 61 separated at the second branching portion 32, is heated and supplied to the fourth branching portion 34. Therefore, in the refrigeration cycle apparatus 200 of each of the first and second modifications, it is possible to reduce a high-boiling component that flows into the third branching portion 33, improve the performance of the compressor 14, and also improve the efficiency in saving energy, without increasing liquid refrigerant that flows into the compression stage of the compressor 14.

The refrigeration cycle apparatus 200 of the second modification as illustrated in FIG. 21 can perform switching between the cooling operation and the heating operation. In the refrigeration cycle apparatus 200 of the second modification, in both the cooling operation and the heating operation, the first refrigerant-to-refrigerant heat exchanger 1 is located downstream of the second refrigerant-to-refrigerant heat exchanger 2 in the flow of high-temperature-side refrigerant through the refrigerant-to-refrigerant heat exchangers. In the refrigeration cycle apparatus 200 of the second modification, by virtue of the above configuration, in both the cooling operation and the heating operation, it is possible to ensure a given temperature difference between the high-boiling main refrigerant 67 separated at the second branching portion 32 and the high-temperature-side refrigerant, and thus improve the performance in the cooling operation and that in the heating operation without increasing the sizes of devices.

In particular, in the case where refrigerant in which the ratio of high-boiling refrigerant to low-boiling refrigerant in a circulatory composition is higher than that of the low-boiling refrigerant to the high-boiling refrigerant is employed as a refrigerant mixture, a temperature change that is made in a two-phase region when the high-boiling main refrigerant 67 separated at the second branching portion 32 is heated decreases. Therefore, in the refrigeration cycle apparatus 200 of the second modification, it is possible to ensure a greater temperature difference between the high-boiling main refrigerant 67 and the high-temperature-side refrigerant, and thus to improve the performance in the cooling operation and that in the heating operation without increasing the sizes of devices.

Embodiment 4

Configuration of Embodiment 4

Figure 22:
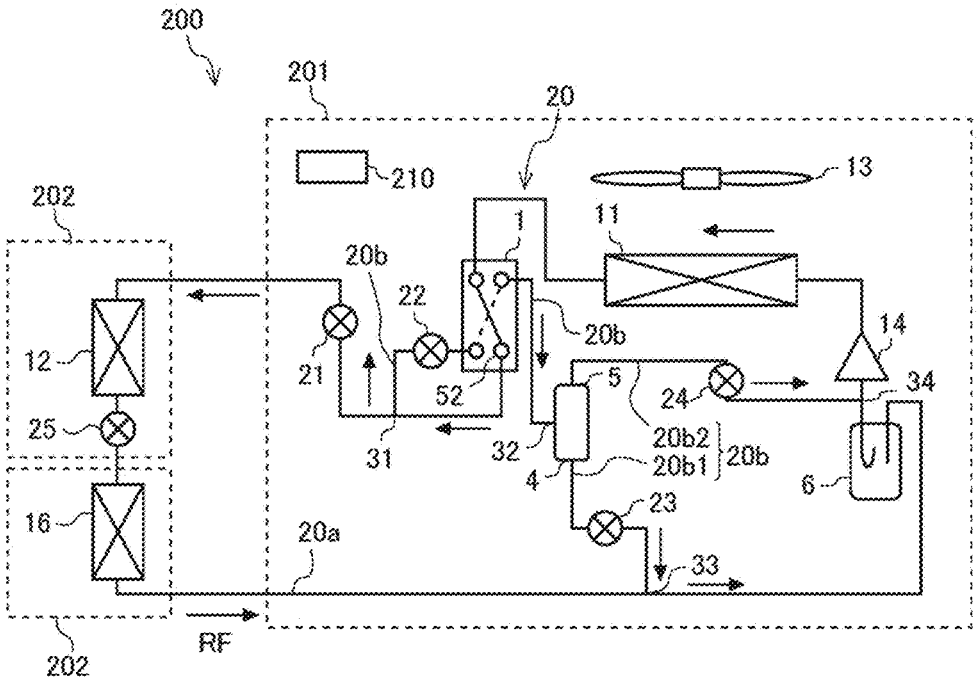
FIG. 22 is a first schematic view illustrating a refrigeration cycle apparatus according to Embodiment 4.
Figure 23:
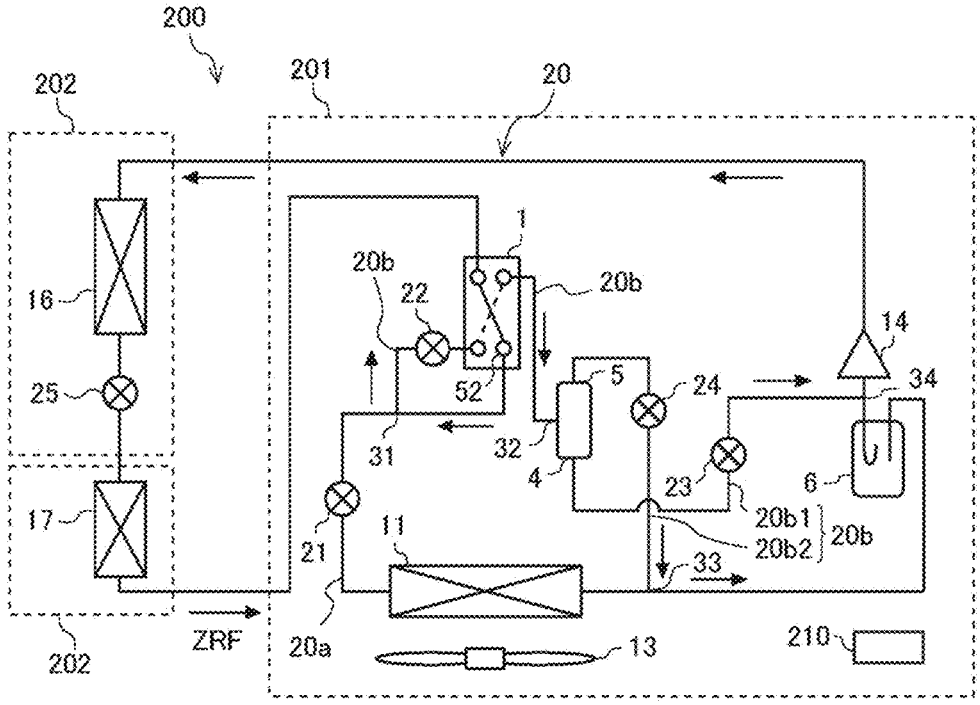
FIG. 23 is a second schematic view illustrating the refrigeration cycle apparatus according to Embodiment 4.

FIG. 22 is a first schematic view illustrating a refrigeration cycle apparatus 200 according to Embodiment 4. FIG. 23 is a second schematic view illustrating the refrigeration cycle apparatus 200 according to Embodiment 4. In FIG. 23, solid arrows indicate the flow direction of refrigerant RF, especially, the flow of a zeotropic refrigerant mixture ZRF. Furthermore, for viewability, in FIGS. 22 and 23, part of the refrigerant flow passage 20 is omitted, and part of the refrigerant flow passage 20 that is used in a cooling main operation or a heating main operation is illustrated. Next, the refrigeration cycle apparatus 200 according to Embodiment 4 will be described with reference to FIGS. 22 and 23.

The refrigeration cycle apparatus 200 according to Embodiment 4 is obtained by modifying part of the refrigeration cycle apparatus 200 according to Embodiment 1, and the basic entire configuration of the refrigeration cycle apparatus 200 of Embodiment 4 is similar to that of the refrigeration cycle apparatus 200 of Embodiment 1. Therefore, regarding the refrigeration cycle apparatus 200 according to Embodiment 4 as illustrated in FIGS. 22 and 23, components that are the same as or correspond to those of the refrigeration cycle apparatus 200 according to Embodiment 1 will be denoted by the same reference signs, and their illustrations and descriptions will be omitted.

The refrigeration cycle apparatus 200 according to Embodiment 4 is capable of perform a mixed operation in which the cooling operation and the heating operation are mixedly performed. The main circuit 20*a* and the bypass circuit 20*b* are each formed as a refrigerant circuit in which the above mixed operation is performed. The refrigeration cycle apparatus 200 according to Embodiment 4 as illustrated in FIG. 22 is an apparatus that performs a cooling main operation that is higher in cooling performance than in heating performance.

In the refrigeration cycle apparatus 200 according to Embodiment 4 as illustrated in FIG. 22, the outdoor heat exchanger 11 operates as the first condenser, and a second indoor heat exchanger 12 that performs the heating operation operates as a second condenser. The second indoor heat exchanger 12 is provided in part of the refrigerant flow passage 20 that is located between the outdoor heat exchanger 11 and the indoor heat exchanger 16. More particularly, the second indoor heat exchanger 12, which operates as the second condenser, is provided in part of the main circuit 20*a* that is located between the first expansion device 21 and the first evaporator. It should be noted that the indoor heat exchanger 16 is the first evaporator that performs the cooling operation.

A fifth expansion device 25 is provided at a pipe between the second indoor heat exchanger 12 and the indoor heat exchanger 16, which are included in the main circuit 20*a*. The first refrigerant-to-refrigerant heat exchanger 1 is provided in part of the refrigerant flow passage 20 that is located between the outdoor heat exchanger 11, which operates as the first condenser, and the second indoor heat exchanger 12, which operates as the second condenser.

The refrigeration cycle apparatus 200 according to Embodiment 4 as illustrated in FIG. 23 is an apparatus that performs a heating main operation that is higher in heating performance than in cooling performance. The main circuit 20*a* and the bypass circuit 20*b* are formed as a refrigerant circuit that performs a mixed operation in which the cooling operation and the heating operation are mixedly performed.

In the refrigeration cycle apparatus 200 according to Embodiment 4 as illustrated in FIG. 23, an indoor heat exchanger 16 that performs the heating operation operates as the first condenser, and the outdoor heat exchanger 11 operates as the first evaporator. Furthermore, a third indoor heat exchanger 17 is provided in part of the refrigerant flow passage 20 that is located between the indoor heat exchanger 16, which operates as the first condenser, and the first expansion device 21. The third indoor heat exchanger 17 is a second evaporator that performs the cooling operation. The second evaporator causes heat exchange to be performed between refrigerant that flows therein and outdoor air, and evaporates and gasifies the refrigerant.

A fifth expansion device 25 is provided at a pipe between the indoor heat exchanger 16 and the third indoor heat exchanger 17. The first refrigerant-to-refrigerant heat exchanger 1 is provided in part of the refrigerant flow passage 20 that is located between the third indoor heat exchanger 17, which operates as the second evaporator, and the outdoor heat exchanger 11, which operates as the first evaporator.

Advantages of Embodiment 4

In general, a refrigeration cycle apparatus supplies cool air or hot air to an indoor space through a plurality of heat exchangers in a cooling only operation or a heating only operation. However, in the cooling main operation and the heating main operation of the refrigeration cycle apparatus, the performance of the refrigeration cycle apparatus is degraded, because cool air or hot air is supplied through a smaller number of heat exchangers.

In an existing refrigeration cycle apparatus in which the second branching portion 32 is not provided, in order to improve the performance of the refrigeration cycle apparatus, the flow rate of refrigerant that flows in the bypass circuit 20*b* is increased. In some cases, the refrigerant that flows in the bypass circuit 20*b* is not sufficiently subjected to heat exchange, and flows in a two-phase gas-liquid state and joins refrigerant that flows in the main circuit 20*a*.

Therefore, in the existing refrigeration cycle apparatus, heat loss and the amount of liquid refrigerant that is supplied to the compressor are both increased, and the performance of the compressor and the efficiency in saving energy are lowered. In view of this point, in the existing refrigeration cycle apparatus, in order to improve the performance of the compressor, the following countermeasures may be taken: the size of a heat exchanger of an indoor unit is increased, and the size of the first refrigerant-to-refrigerant heat exchanger 1 is increased, or the size of the refrigerant tank 6 is increased in order that high-boiling refrigerant be stored in the refrigerant tank 6.

The refrigeration cycle apparatus 200 according to Embodiment 4 separates the gas main refrigerant 62 and the liquid main refrigerant 61 from each other at the second branching portion 32 located downstream of the first refrigerant-to-refrigerant heat exchanger 1. Moreover, in the refrigeration cycle apparatus 200 as illustrated in FIG. 22, the gas main refrigerant 62 and the refrigerant that flows in the main circuit 20*a* join each other at the fourth branching portion 34.

Therefore, in the refrigeration cycle apparatus 200, the liquid flow rate of refrigerant that is supplied to the compressor 14 is reduced relative to liquid refrigerant that is let out from the refrigerant tank 6, and it is not necessary to increase the sizes of devices such as the refrigerant tank 6. Furthermore, in the refrigeration cycle apparatus 200, it is possible to improve the performance thereof by increasing the flow rate of the refrigerant that flows in the bypass circuit 20*b* and reducing a pressure loss caused by the refrigerant that flows in the main circuit 20*a*.

Furthermore, the refrigerant at the high-temperature-side flow passage outlet 52 of the first refrigerant-to-refrigerant heat exchanger 1 is two-phase gas-liquid refrigerant. In the refrigeration cycle apparatus 200, the opening degree of the second expansion device 22 is reduced to a smaller value than that of the first expansion device 21, whereby gas refrigerant having a high volumetric flow rate flows mainly in the main circuit 20*a* and liquid refrigerant having a low volumetric flow rate flows mainly in the bypass circuit 20*b*.

In particular, in the case where the refrigeration cycle apparatus 200 uses a zeotropic refrigerant mixture as the working fluid, a low-boiling component serving as the gas main refrigerant 62 flows in the main circuit 20*a*, and a high-boiling component serving as the liquid main refrigerant 61 flows in the bypass circuit 20*b*. Therefore, in the case where the refrigeration cycle apparatus 200 uses a zeotropic refrigerant mixture as the working fluid, a lower pressure loss is achieved and a greater performance improvement effect is obtained.

Configuration of Modification of Embodiment 4

Figure 24:
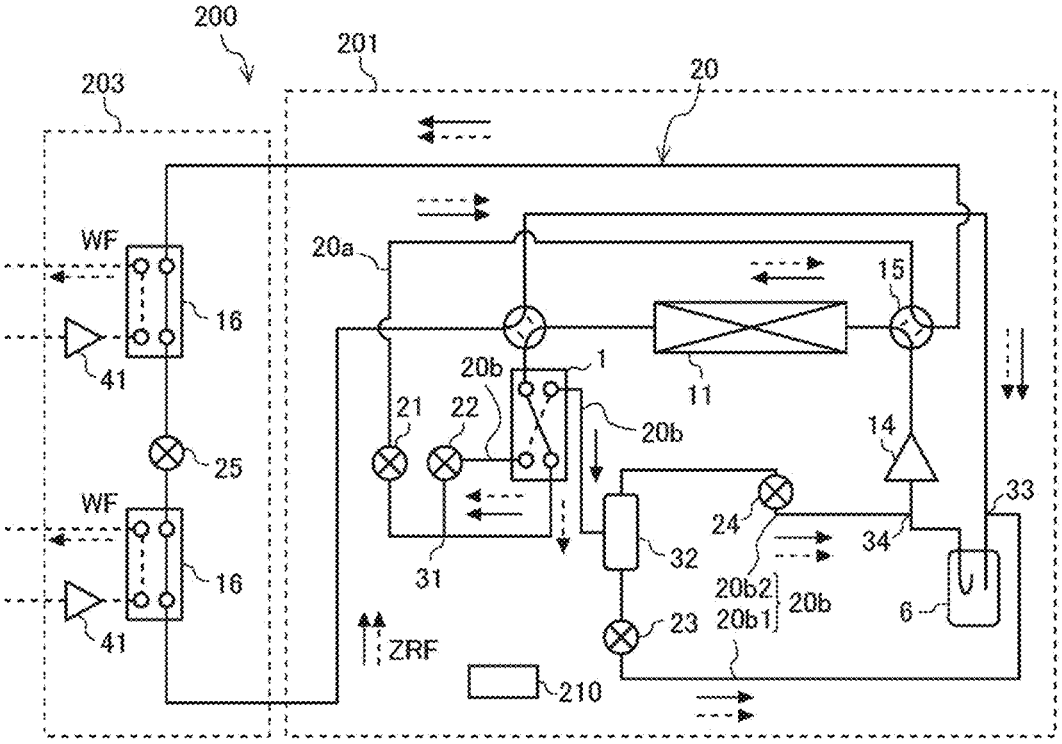
FIG. 24 is a schematic view illustrating a first modification of the refrigeration cycle apparatus according to Embodiment 4.
Figure 25:
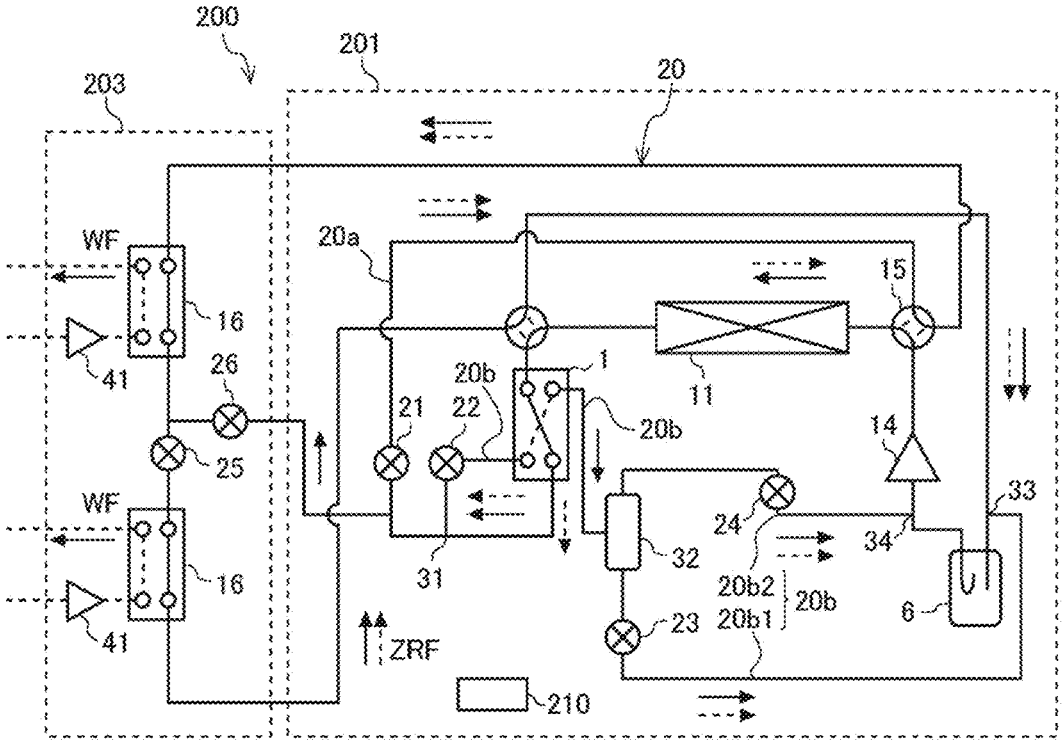
FIG. 25 is a schematic view illustrating a second modification of the refrigeration cycle apparatus according to Embodiment 4.

FIG. 24 is a schematic view illustrating a first modification of the refrigeration cycle apparatus 200 according to Embodiment 4. FIG. 25 is a schematic view illustrating a second modification of the refrigeration cycle apparatus 200 according to Embodiment 4. In FIGS. 24 and 25, solid arrows indicate the flow direction of refrigerant RF, particularly the flow of a zeotropic refrigerant mixture ZRF. As illustrated in FIG. 23, the indoor heat exchanger 16 may be a heat exchanger provided in a relay unit 203 that transfers a heat medium to the indoor unit 202.

Advantages of Modification of Embodiment 4

In general, in a refrigeration cycle apparatus not including the second branching portion 32, in the case where a heat medium that carries heat from the relay unit 203 to the indoor unit 202 is water, the water freezes when the saturation temperature of the indoor heat exchanger 16, which operates as an evaporator in the cooling main operation, drops. Thus, in the refrigeration cycle apparatus not including the second branching portion 32, it may be necessary to take a countermeasure, for example, it may be necessary to increase the size of the indoor heat exchanger 16, which operates as an evaporator.

In the refrigeration cycle apparatus 200, which includes the second branching portion 32, since a low pressure loss can be ensured in the cooling main operation, it is possible to raise an evaporating temperature without increasing the size of the indoor heat exchanger 16, which operates as an evaporator, and improve the performance per capacity without increasing the sizes of devices.

The number of refrigerant flow passages 20 that connect the outdoor unit 201 and the relay unit 203 may be set to three or more as in the refrigeration cycle apparatus 200 of the second modification as illustrated in FIG. 25. For example, in the case where the relay unit 203 is provided with a plurality of indoor heat exchangers 16, the outdoor unit 201 and the relay unit 203 may be connected via the sixth expansion device 26 from a flow passage extending from the first branching portion 31 to the first expansion device 21 to a flow passage between the two indoor heat exchangers 16 provided in the relay unit 203.

In the refrigeration cycle apparatus 200, in the case where the sixth expansion device 26 is provided, it is possible to control the flow rate of refrigerant that flows the two indoor heat exchangers 16 by adjusting the opening degree of the sixth expansion device 26 in the mixed operation in which the cooling operation and the heating operation are mixedly performed. The sixth expansion device 26 is controlled, for example, by the controller 210. By virtue of such a configuration, in the refrigeration cycle apparatus 200, it is possible to increase the range of control regarding an operation performance ratio between the cooling operation and the heating operation without increasing the sizes of devices or without lowering the energy saving performance.

Furthermore, the above configurations described regarding in Embodiments 1 to 4 are examples of the contents of the present disclosure and may be combined with a well-known technique, and part of the configurations may be omitted or modified without departing from the gist of the present disclosure.

REFERENCE SIGNS LIST

1: first refrigerant-to-refrigerant heat exchanger, 1*a*: high-temperature-side flow passage, 1*b*: low-temperature-side flow passage, 1*c*: heat transfer plate, 1*d*: main body, 2: second refrigerant-to-refrigerant heat exchanger, 3: inflow pipe, 3*a*: inlet, 3*b*: center, 4: liquid outflow pipe, 4*a*: outlet, 5: gas outflow pipe, 5*a*: outlet, 6: refrigerant tank, 7: injection port, 8: expanded portion, 8*a*: main body, 8*b*: lid, 8*b*1: opening, 8*c*: tube axis, 8*d*: through hole, 11: outdoor heat exchanger, 12: second indoor heat exchanger, 13: outdoor fan, 14: compressor, 14*a*: suction inlet, 14*b*: discharge outlet, 15: flow switching device, 16: indoor heat exchanger, 17: third indoor heat exchanger, 18: indoor fan, 20: refrigerant flow passage, 20*a*: main circuit, 20*b*: bypass circuit, 20*b*1: first branch passage, 20*b*2: second branch passage, 21: first expansion device, 22: second expansion device, 23: third expansion device, 24: fourth expansion device, 25: fifth expansion device, 26: sixth expansion device, 31: first branching portion, 32: second branching portion, 33: third branching portion, 34: fourth branching portion, 42: check valve, 51: high-temperature-side flow passage inlet, 52: high-temperature-side flow passage outlet, 53: low-temperature-side flow passage inlet, 54: low-temperature-side flow passage outlet, 61: liquid main refrigerant, 62: gas main refrigerant, 63: liquid refrigerant, 64: gas refrigerant, 65: liquid refrigerant, 66: gas refrigerant, 67: high-boiling main refrigerant, 66: low-boiling main refrigerant, 100: direction of gravitational force, 101: normal, 102: horizontal plane, 200: refrigeration cycle apparatus, 201: outdoor unit 202: indoor unit, 203: relay unit, 210: controller

The invention claimed is:

1. A refrigeration cycle apparatus comprising:

a main circuit in which piping is installed to allow refrigerant to flow in the main circuit; and a bypass circuit in which piping is installed to allow the refrigerant to flow in the bypass circuit, the bypass circuit being provided to branch off from the main circuit and join the main circuit, wherein the main circuit includes a compressor configured to compress the refrigerant, a first condenser configured to condense the refrigerant, a first refrigerant-to-refrigerant heat exchanger configured to cause heat exchange to be performed between the refrigerant which flows through high-temperature-side flow passages formed in the first refrigerant-to-refrigerant heat exchanger and the refrigerant which flows through low-temperature-side flow passages formed in the first refrigerant-to-refrigerant heat exchanger, the high-temperature-side flow passages forming part of the main circuit, a first expansion device configured to decompress the refrigerant, a first branching portion provided in a refrigerant passage that extends from the first refrigerant-to-refrigerant heat exchanger to the first expansion device, the first branching portion having at least three branches, a first evaporator configured to evaporate the refrigerant, a third branching portion provided in a refrigerant passage that extends from the first evaporator to a suction inlet of the compressor, the third branching portion having at least three branches, and a fourth branching portion provided in a refrigerant passage that extends from the third branching portion to a discharge outlet of the compressor, the fourth branching portion having at least three branches, wherein the bypass circuit forms a refrigerant passage that extends from the first branching portion to the third branching portion and the fourth branching portion, and includes a second expansion device provided in a refrigerant passage between the first branching portion and the low-temperature-side flow passages of the first refrigerant-to-refrigerant heat exchanger, and configured to decompress the refrigerant, the first refrigerant-to-refrigerant heat exchanger, the low-temperature-side flow passages in the first refrigerant-to-refrigerant heat exchanger forming part of the bypass circuit, and a second branching portion provided in a refrigerant flow passage between the low-temperature-side flow passages and the third branching portion and between the low-temperature-side flow passages and the fourth branching portion, and configured to bifurcate the refrigerant which flows out from the low-temperature-side flow passages of the first refrigerant-to-refrigerant heat exchanger, and wherein the second branching portion includes a liquid outflow pipe and a gas outflow pipe, the liquid outflow pipe defining a liquid outlet for the refrigerant which is below the gas outflow pipe, the gas outflow pipe defining a gas outlet for the refrigerant and being above the liquid outflow pipe, the liquid outlet of the second branching portion, which is defined by the liquid outflow pipe, including a pipe that connects the liquid outflow pipe and the third branching portion, the gas outlet of the second branching portion, which is defined by the gas outflow pipe, including a pipe that connects the gas outflow pipe and the fourth branching portion.

2. The refrigeration cycle apparatus of claim 1, wherein;

the second branching portion is a positive-displacement gas-liquid separator.

3. The refrigeration cycle apparatus of claim 1, further comprising:

a positive-displacement refrigerant tank between the third branching portion and the fourth branching portion.

4. The refrigeration cycle apparatus of claim 1, wherein;

the compressor includes two compressors, the two compressors are connected in series in a flow direction of the refrigerant and located downstream of the third branching portion in the flow direction of the refrigerant, and the fourth branching portion is between the two compressors located downstream of the third branching portion in the flow direction of the refrigerant.

5. The refrigeration cycle apparatus of claim 1, wherein:

the compressor includes an intermediate-pressure injection port that allows the refrigerant to be injected into a compressor chamber of the compressor, and the fourth branching portion is the intermediate-pressure injection port.

6. The refrigeration cycle apparatus of claim 1, wherein:

the first refrigerant-to-refrigerant heat exchanger includes a main body in which the high-temperature-side flow passages and the low-temperature-side flow passages alternate between stacked plates, the main body includes:

a high-temperature-side flow passage inlet that is an inlet of the high-temperature-side flow passages that allows the refrigerant to flow thereinto, a high-temperature-side flow passage outlet that is an outlet of the high-temperature-side flow passages that allows the refrigerant to flow out therefrom toward the first branching portion, a low-temperature-side flow passage inlet that is an inlet of the low-temperature-side flow passages that allows the refrigerant which has branched off from the first branching portion and passed through the second expansion device to flow into the low-temperature-side flow passages, and a low-temperature-side flow passage outlet that is an outlet of the low-temperature-side flow passages that allows the refrigerant to flow out therefrom toward the second branching portion, and the high-temperature-side flow passage outlet and the low-temperature-side flow passage inlet are below the low-temperature-side flow passage outlet.

7. The refrigeration cycle apparatus of claim 1, wherein:

the gas outflow pipe of the second branching portion is connected to the fourth branching portion, and the liquid outflow pipe of the second branching portion is connected to the third branching portion.

8. The refrigeration cycle apparatus of claim 5, wherein;

the gas outflow pipe of the second branching portion is connected to the third branching portion, the liquid outflow pipe of the second branching portion is connected to the fourth branching portion, and a zeotropic refrigerant mixture of at least two kinds of refrigerant whose normal boiling points differ from each other by 1 degree C. or more is used as a working fluid.

9. The refrigeration cycle apparatus of claim 8, further comprising:

a second refrigerant-to-refrigerant heat exchanger having two refrigerant flow passages therein to allow heat exchange to be performed between refrigerant that flows through a flow passage extending from the first condenser of the main circuit to the first expansion device and refrigerant that flows through a flow passage extending from the liquid outflow pipe to the fourth branching portion.

10. The refrigeration cycle apparatus of claim 9, further comprising:

a flow switch to switch a flow direction of the refrigerant through a refrigerant flow passage; and a controller configured to control the flow switch to perform switching between a cooling operation and a heating operation, wherein in each of the cooling operation and the heating operation, the first refrigerant-to-refrigerant heat exchanger is located downstream of the second refrigerant-to-refrigerant heat exchanger in a flow direction of the refrigerant that flows through the high-temperature-side flow passages of the first refrigerant-to-refrigerant heat exchanger.

11. The refrigeration cycle apparatus of claim 1, further comprising:

a second condenser provided between the first expansion device and the first evaporator in the main circuit, wherein:

the main circuit and the bypass circuit are a refrigerant circuit in which a mixed operation is performed, the mixed operation being an operation in which a cooling operation and a heating operation are mixedly operated, when a cooling main operation that is higher in cooling performance than in heating performance is performed, the first condenser is an outdoor heat exchanger, and the second condenser is an indoor heat exchanger, and the first refrigerant-to-refrigerant heat exchanger is between the first condenser and the second condenser.

12. The refrigeration cycle apparatus of claim 1, wherein:

the main circuit and the bypass circuit are a refrigerant circuit in which a mixed operation is performed, the mixed operation being an operation in which a cooling operation and a heating operation are mixedly performed, when a heating main operation that is higher in heating performance than in cooling performance is performed, the first condenser is an indoor heat exchanger used in the heating operation, and the first evaporator is an outdoor heat exchanger, the refrigeration cycle apparatus further comprising a second evaporator a refrigerant flow passage extending from the first condenser to the first expansion device, the second evaporator being configured to evaporate the refrigerant.

13. The refrigeration cycle apparatus of claim 1, wherein:

the refrigerant which flows through the main circuit and the bypass circuit is refrigerant that is lower in gas density than R32 refrigerant and that contains any one or more of olefin-based refrigerant, ethylene-based refrigerant, ethane-based refrigerant, propane, and dimethyl ether.

14. The refrigeration cycle apparatus of claim 1, wherein: the second branching portion is a T-shaped pipe.

15. The refrigeration cycle apparatus of claim 1, wherein: the first refrigerant-to-refrigerant heat exchanger is a plate heat exchanger in which the high-temperature-side flow passages alternate with the low-temperature-side flow passages.

16. The refrigeration cycle apparatus as in claim 1, wherein:

the compressor is one of a rotary compressor, a scroll compressor, a screw compressor, and a reciprocating compressor.

17. The refrigeration cycle apparatus of claim 1, wherein: the first expansion device and the second expansion device are electric expansion valves.

18. A refrigeration cycle apparatus as in claim 1, further comprising:

a flow switch; and control circuitry configured to control the flow switch to perform switching between a cooling operation and a heating operation.

19. The refrigeration cycle apparatus of claim 1, wherein: the second branching portion further comprises an expanded portion between the liquid outflow pipe and the gas outflow pipe, the expanded portion having a larger diameter than the liquid outflow pipe and the gas outflow pipe.

20. The refrigeration cycle apparatus of claim 1, wherein: the refrigerant is a zeotropic refrigerant mixture of at least two kinds of refrigerant whose boiling points differ from each other by 1 degree C. or more.

* * * * *